US009011641B2

(12) United States Patent
Mohammadi et al.

(10) Patent No.: US 9,011,641 B2
(45) Date of Patent: Apr. 21, 2015

(54) FIBROUS STRUCTURES AND METHODS FOR MAKING SAME

(71) Applicant: The Procter & Gamble Company, Cincinnati, OH (US)

(72) Inventors: Khosrow Parviz Mohammadi, Liberty Township, OH (US); John Allen Manifold, Sunman, IN (US); James Edmond Haas, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/905,605

(22) Filed: May 30, 2013

(65) Prior Publication Data

US 2013/0319625 A1 Dec. 5, 2013

Related U.S. Application Data

(60) Provisional application No. 61/654,373, filed on Jun. 1, 2012.

(51) Int. Cl.

| | |
|---|---|
| ***D21H 27/02*** | (2006.01) |
| ***B31F 1/12*** | (2006.01) |
| ***D21H 27/00*** | (2006.01) |

(52) U.S. Cl.
CPC *D21H 27/02* (2013.01); *B31F 1/12* (2013.01); *D21H 27/004* (2013.01)

(58) Field of Classification Search
CPC ..... D21H 27/02; D21H 27/005; D21H 27/40; D21H 27/002; B31F 1/07; A47K 10/16
USPC ..... 162/111, 117, 123–133, 141, 142, 162/148–149; 428/153, 156, 172, 340
See application file for complete search history.

(56) References Cited

U.S. PATENT DOCUMENTS

| | | | | |
|---|---|---|---|---|
| 5,690,788 | A * | 11/1997 | Marinack et al. | 162/113 |
| 7,217,339 | B2 * | 5/2007 | Mohammadi et al. | 162/158 |
| 7,691,472 | B2 * | 4/2010 | Vinson et al. | 428/292.1 |
| 7,811,613 | B2 * | 10/2010 | Vinson et al. | 424/745 |
| 8,029,645 | B2 * | 10/2011 | Mohammadi | 162/129 |
| 8,056,841 | B2 * | 11/2011 | Vinson et al. | 241/24.1 |
| 8,297,543 | B2 * | 10/2012 | Vinson et al. | 241/24.1 |
| 8,425,722 | B2 * | 4/2013 | Mohammadi | 162/148 |
| 2006/0288639 | A1 * | 12/2006 | Vinson et al. | 47/9 |
| 2007/0011762 | A1 * | 1/2007 | Vinson et al. | 800/278 |
| 2009/0054858 | A1 | 2/2009 | Cheng et al. | |
| 2010/0040825 | A1 | 2/2010 | Manifold et al. | |
| 2010/0319250 | A1 * | 12/2010 | Vinson et al. | 47/58.1 R |
| 2011/0168342 | A1 | 7/2011 | Mohammadi et al. | |
| 2011/0226430 | A1 * | 9/2011 | Mohammadi | 162/148 |
| 2011/0308749 | A1 * | 12/2011 | Mohammadi | 162/129 |
| 2012/0058890 | A1 * | 3/2012 | Vinson et al. | 502/401 |
| 2012/0090112 | A1 * | 4/2012 | Carrier et al. | 15/104.93 |
| 2012/0090113 | A1 * | 4/2012 | Manifold et al. | 15/104.93 |
| 2012/0107568 | A1 * | 5/2012 | Manifold et al. | 428/169 |
| 2013/0025808 | A1 * | 1/2013 | Vinson et al. | 162/202 |
| 2013/0040101 | A1 * | 2/2013 | Fung et al. | 428/141 |
| 2013/0048239 | A1 * | 2/2013 | Fung et al. | 162/116 |
| 2013/0143001 | A1 * | 6/2013 | Manifold et al. | 428/167 |
| 2013/0186580 | A1 * | 7/2013 | Kavalew et al. | 162/111 |
| 2013/0213595 | A1 * | 8/2013 | Mohammadi | 162/146 |
| 2013/0216789 | A1 * | 8/2013 | Kraus et al. | 428/172 |
| 2013/0220563 | A1 * | 8/2013 | Mohammadi | 162/146 |
| 2013/0319625 | A1 * | 12/2013 | Mohammadi et al. | 162/111 |

FOREIGN PATENT DOCUMENTS

| | | | |
|---|---|---|---|
| WO | WO 2006137041 | A2 * | 12/2006 |
| WO | WO 2007002171 | A1 * | 1/2007 |
| WO | WO 2010022012 | A1 * | 2/2010 |
| WO | WO 2010135270 | A1 * | 11/2010 |

OTHER PUBLICATIONS

International Search Report mailed Jul. 26, 2013.

* cited by examiner

*Primary Examiner* — Jose Fortuna
(74) *Attorney, Agent, or Firm* — Wednesday G. Shipp; C. Brant Cook

(57) ABSTRACT

Fibrous structures that exhibit a Free Fiber End Count greater than the Free Fiber End Count of known fibrous structures in the range of free fiber end lengths of from about 0.10 mm to about 0.75 mm as determined by the Free Fiber End Test Method, and sanitary tissue products comprising same and methods for making same are provided.

15 Claims, 19 Drawing Sheets

FIBROUS STRUCTURES AND METHODS FOR MAKING SAME

FIELD OF THE INVENTION

The present invention relates to a fibrous structure that can exhibit a Free Fiber End Count greater than the Free Fiber End Count of known fibrous structures in the range of free fiber end lengths of from about 0.10 mm to about 0.75 mm as determined by the Free Fiber End Test Method, sanitary tissue products comprising same and methods for making same.

BACKGROUND OF THE INVENTION

Fibrous structures, particularly sanitary tissue products comprising fibrous structures, are known to exhibit different values for particular properties. These differences may translate into one fibrous structure being softer or stronger or more absorbent or more flexible or less flexible or exhibit greater stretch or exhibit less stretch, for example, as compared to another fibrous structure.

One property of fibrous structures that is desirable to consumers is softness and/or feel and/or tactile impression of a fibrous structure. It has been found that at least some consumers desire fibrous structures that exhibit softness that corresponds to a Free Fiber End Count of greater than 130 in the range of free fiber end lengths of from about 0.1 mm to about 0.25 mm and/or greater than 160 in the range of free fiber end lengths of from about 0.25 mm to about 0.50 mm and/or greater than 50 in the range of free fiber end lengths of from about 0.50 mm to about 0.75 mm as determined by the Free Fiber End Test Method. However, such fibrous structures are not known in the art. Accordingly, there exists a need for fibrous structures that exhibit such softness by having a Free Fiber End Count of greater than 130 in the range of free fiber end lengths of from about 0.1 mm to about 0.25 mm and/or greater than 160 in the range of free fiber end lengths of from about 0.25 mm to about 0.50 mm and/or greater than 50 in the range of free fiber end lengths of from about 0.50 mm to about 0.75 mm as determined by the Free Fiber End Test Method, sanitary tissue products comprising such fibrous structures and method for making such fibrous structures.

SUMMARY OF THE INVENTION

The present invention fulfills the need described above by providing fibrous structures that exhibit a Free Fiber End Count of greater than the Free Fiber End Count of known fibrous structures in the range of free fiber end lengths of from about 0.10 mm to about 0.75 mm as determined by the Free Fiber End Test Method, sanitary tissue products comprising the same and methods for making the same.

In one example of the present invention, a fibrous structure, for example a fibrous structure comprising trichomes, that exhibits a Free Fiber End Count of greater than 130 and/or greater than 135 and/or greater than 140 in the range of free fiber end lengths of from about 0.1 mm to about 0.25 mm as determined by the Free Fiber End Test Method, is provided.

In another example of the present invention, a fibrous structure, for example a fibrous structure comprising trichomes, that exhibits a Free Fiber End Count of greater than 93 and/or greater than 95 and/or greater than 100 and/or greater than 105 in the range of free fiber end lengths of from about 0.1 mm to about 0.20 mm as determined by the Free Fiber End Test Method, is provided.

In still another example of the present invention, a fibrous structure, for example a fibrous structure comprising trichomes, that exhibits a Free Fiber End Count of greater than 160 and/or greater than 170 and/or greater than 180 and/or greater than 190 in the range of free fiber end lengths of from about 0.25 mm to about 0.50 mm as determined by the Free Fiber End Test Method, is provided.

In yet another example of the present invention, a fibrous structure, for example a fibrous structure comprising trichomes, that exhibits a Free Fiber End Count of greater than 110 and/or greater than 115 and/or greater than 120 and/or greater than 125 in the range of free fiber end lengths of from about 0.25 mm to about 0.40 mm as determined by the Free Fiber End Test Method, is provided.

In still another example of the present invention, a fibrous structure, for example a fibrous structure comprising trichomes, that exhibits a Free Fiber End Count of greater than 80 and/or greater than 85 in the range of free fiber end lengths of from about 0.25 mm to about 0.35 mm as determined by the Free Fiber End Test Method, is provided.

In even another example of the present invention, a fibrous structure, for example a fibrous structure comprising trichomes, that exhibits a Free Fiber End Count of greater than 50 and/or greater than 55 and/or greater than 60 and/or greater than 70 and/or greater than 80 in the range of free fiber end lengths of from about 0.50 mm to about 0.75 mm as determined by the Free Fiber End Test Method, is provided.

In still yet another example of the present invention, a fibrous structure, for example a fibrous structure comprising trichomes, that exhibits a Free Fiber End Count of greater than 40 and/or greater than 45 and/or greater than 50 in the range of free fiber end lengths of from about 0.50 mm to about 0.65 mm as determined by the Free Fiber End Test Method, is provided.

In even still yet another example of the present invention, a single- or multi-ply sanitary tissue product comprising a fibrous structure according to the present invention, is provided.

Without being bound by theory, it is believed that fibrous structures having free fiber end counts in accordance with the present invention are desired by consumers because the free fiber ends improve softness of fibrous structures and softness is a foundational consumer need/benefit in fibrous structures, especially toilet tissue and facial tissue products. Free fiber ends, in particular, relate to the fuzzy, surface evenness and scratchiness sensory measures. Previous attempts to address the consumers' needs for more softness have focused on increasing the total number of free fiber ends. The free fiber ends count and length distribution of the present invention results in the fibrous structure feeling more like a velvety cloth on its surface.

Accordingly, the present invention provides fibrous structures that exhibit Free Fiber End Counts as determined by the Free Fiber End Test Method that result in the fibrous structures being desirable and even more desirable to consumers than known fibrous structures with lower Free Fiber End Counts, sanitary tissue products comprising such fibrous structures and method for making such fibrous structures.

DETAILED DESCRIPTION OF THE INVENTION

Definitions

Figure 1:
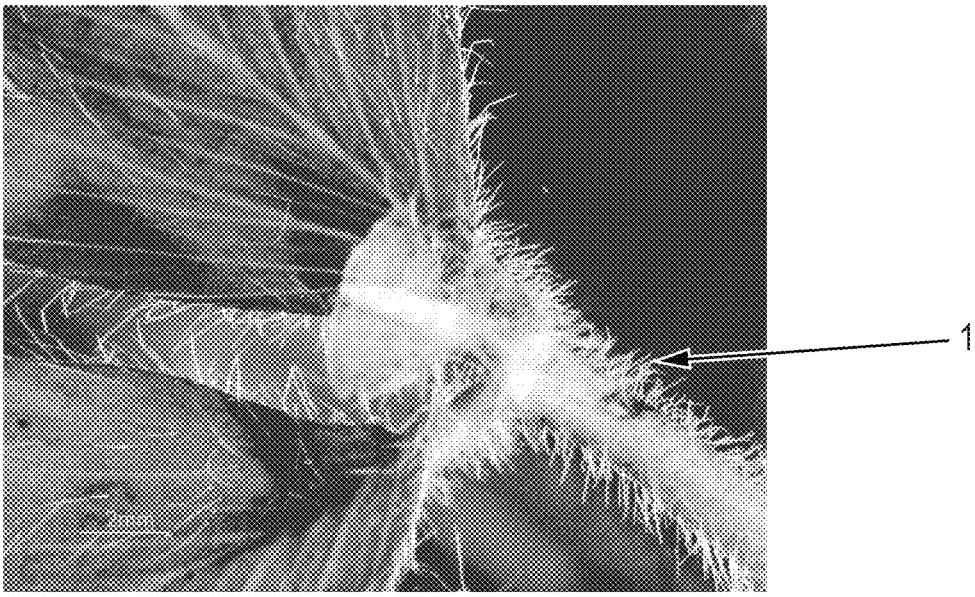
FIG. 1 is a light micrograph of a leaf and leaf stem illustrating trichomes present on red clover, *Trifolium pratense* L.

"Trichome" as used herein means an epidermal attachment of a varying shape, structure and/or function of a non-seed portion of a plant. In one example, a trichome is an outgrowth of the epidermis of a non-seed portion of a plant. The outgrowth may extend from an epidermal cell. In one embodiment, the outgrowth is a trichome fiber. The outgrowth may be a hairlike or bristlelike outgrowth from the epidermis of a plant.

Trichomes may protect the plant tissues present on a plant. Trichomes may for example protect leaves and stems from attack by other organisms, particularly insects or other foraging animals and/or they may regulate light and/or temperature and/or moisture. They may also produce glands in the forms of scales, different papills and, in roots, often they may function to absorb water and/or moisture.

A trichome may be formed by one cell or many cells.

The term "individualized trichome" as used herein means trichomes which have been artificially separated by a suitable method for individualizing trichomes from their host plant. In other words, individualized trichomes as used herein means that the trichomes become separated from a non-seed portion of a host plant by some non-naturally occurring action. In one example, individualized trichomes are artificially separated in a location that is sheltered from nature. Primarily, individualized trichomes will be fragments or entire trichomes with essentially no remnant of the host plant attached. However, individualized trichomes can also comprise a minor fraction of trichomes retaining a portion of the host plant still attached, as well as a minor fraction of trichomes in the form of a plurality of trichomes bound by their individual attachment to a common remnant of the host plant. Individualized trichomes may comprise a portion of a pulp or mass further comprising other materials. Other materials include non-trichome-bearing fragments of the host plant.

In one example of the present invention, the individualized trichomes may be classified to enrich the individualized trichomal content at the expense of mass not constituting individualized trichomes.

Individualized trichomes may be converted into chemical derivatives including but not limited to cellulose derivatives, for example, regenerated cellulose such as rayon; cellulose ethers such as methyl cellulose, carboxymethyl cellulose, and hydroxyethyl cellulose; cellulose esters such as cellulose acetate and cellulose butyrate; and nitrocellulose. Individualized trichomes may also be used in their physical form, usually fibrous, and herein referred to "trichome fibers", as a component of fibrous structures.

Trichome fibers are different from seed hair fibers in that they are not attached to seed portions of a plant. For example, trichome fibers, unlike seed hair fibers, are not attached to a seed or a seed pod epidermis. Cotton, kapok, milkweed, and coconut coir are non-limiting examples of seed hair fibers.

Further, trichome fibers are different from nonwood bast and/or core fibers in that they are not attached to the bast, also known as phloem, or the core, also known as xylem portions of a nonwood dicotyledonous plant stem. Non-limiting examples of plants which have been used to yield nonwood bast fibers and/or nonwood core fibers include kenaf, jute, flax, ramie and hemp.

Further trichome fibers are different from monocotyledonous plant derived fibers such as those derived from cereal straws (wheat, rye, barley, oat, etc), stalks (corn, cotton, sorghum, *Hesperaloe funifera*, etc.), canes (bamboo, bagasse, etc.), grasses (esparto, lemon, sabai, switchgrass, etc), since such monocotyledonous plant derived fibers are not attached to an epidermis of a plant.

Further, trichome fibers are different from leaf fibers in that they do not originate from within the leaf structure. Sisal and abaca are sometimes liberated as leaf fibers.

Finally, trichome fibers are different from wood pulp fibers since wood pulp fibers are not outgrowths from the epidermis of a plant; namely, a tree. Wood pulp fibers rather originate from the secondary xylem portion of the tree stem.

"Fiber" and/or "Filament" as used herein means an elongate physical structure having an apparent length greatly exceeding its apparent diameter, i.e. a length to diameter ratio of at least about 10. In one example, a "fiber" is an elongate physical structure that exhibits a length of less than 5.08 cm (2 in.) and a "filament" is an elongate physical structure that exhibits a length of greater than or equal to 5.08 cm (2 in.).

Fibers and/or filaments having a non-circular cross-section and/or tubular shape are common; the "diameter" in this case may be considered to be the diameter of a circle having cross-sectional area equal to the cross-sectional area of the fiber and/or filament.

Fibers are typically considered discontinuous in nature. Non-limiting examples of fibers include wood pulp fibers and synthetic staple fibers such as polyester fibers. More specifically, as used herein, "fiber" refers to fibrous structure-making fibers. The present invention contemplates the use of a variety of fibrous structure-making fibers, such as, for example, natural fibers, such as trichome fibers and/or wood pulp fibers, or synthetic fibers, or any other suitable fibers, and any combination thereof.

Natural fibrous structure-making fibers useful in the present invention include animal fibers, mineral fibers, other plant fibers (in addition to the trichomes of the present invention) and mixtures thereof. Animal fibers may, for example, be selected from the group consisting of: wool, silk and mixtures thereof. The other plant fibers may, for example, be derived from a plant selected from the group consisting of: wood, cotton, cotton linters, flax, sisal, abaca, hemp, hesperaloe, jute, bamboo, bagasse, kudzu, corn, sorghum, gourd, agave, loofah and mixtures thereof.

Wood fibers, often referred to as wood pulps or wood pulp fibers, include chemical pulps, such as kraft (sulfate) and sulfite pulps, as well as mechanical and semi-chemical pulps including, for example, groundwood, thermomechanical pulp, chemi-mechanical pulp (CMP), chemi-thermomechanical pulp (CTMP), neutral semi-chemical sulfite pulp (NSCS). Chemical pulps are believed to impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified and/or layered web. U.S. Pat. Nos. 4,300,981 and 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

The wood pulp fibers may be short (typical of hardwood fibers) or long (typical of softwood fibers). Non-limiting examples of short fibers include fibers derived from a fiber source selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, and Magnolia. Non-limiting examples of long fibers include fibers derived from Pine, Spruce, Fir, Tamarack, Hemlock, Cypress, and Cedar. Softwood fibers derived from the kraft process and originating from more-northern climates may be preferred. These are often referred to as Northern Softwood Kraft (NSK) pulps.

The hardwood pulps may comprise tropical hardwood pulps, such as eucalyptus pulp fibers and acacia pulp fibers. The softwood pulps may comprise Northern Softwood Kraft pulps (NSK) and/or Southern Softwood Kraft (SSK) pulps.

In one example of the present invention, the fibrous structure comprises greater than 50% by weight of the total fibers of hardwood pulp fibers.

In addition to the various wood pulp fibers, other cellulosic fibers such as cotton linters, rayon, lyocell and bagasse can be used in this invention. Other sources of cellulose in the form of fibers or capable of being spun into fibers include grasses and grain sources.

Synthetic fibers may be selected from the group consisting of: wet spun fibers, dry spun fibers, melt spun (including melt blown) fibers, synthetic pulp fibers and mixtures thereof. Synthetic fibers may, for example, be comprised of cellulose (often referred to as "rayon"); cellulose derivatives such as esters, ether, or nitrous derivatives; polyolefins (including polyethylene and polypropylene); polyesters (including polyethylene terephthalate); polyamides (often referred to as "nylon"); acrylics; non-cellulosic polymeric carbohydrates (such as starch, chitin and chitin derivatives such as chitosan); polylactic acids, polyhydroxyalkanoates, polycaprolactones, and mixtures thereof. In one example, synthetic fibers may be used as binding agents.

The fibrous structure of the present invention may comprise fibers, films and/or foams that comprise a hydroxyl polymer and optionally a crosslinking system. Non-limiting examples of suitable hydroxyl polymers include polyols, such as polyvinyl alcohol, polyvinyl alcohol derivatives, polyvinyl alcohol copolymers, starch, starch derivatives, chitosan, chitosan derivatives, cellulose derivatives such as cellulose ether and ester derivatives, gums, arabinans, galactans, proteins and various other polysaccharides and mixtures thereof. For example, a fibrous structure of the present invention may comprise a continuous or substantially continuous fiber comprising a starch hydroxyl polymer and a polyvinyl alcohol hydroxyl polymer produced by dry spinning and/or solvent spinning (both unlike wet spinning into a coagulating bath) a composition comprising the starch hydroxyl polymer and the polyvinyl alcohol hydroxyl polymer.

Filaments are typically considered continuous or substantially continuous in nature. Filaments are relatively longer than fibers. Non-limiting examples of filaments include melt-blown and/or spunbond filaments. Non-limiting examples of materials that can be spun into filaments include natural polymers, such as starch, starch derivatives, cellulose and cellulose derivatives, hemicellulose, hemicellulose derivatives, and synthetic polymers including, but not limited to polyvinyl alcohol filaments and/or polyvinyl alcohol derivative filaments, and thermoplastic polymer filaments, such as polyesters, nylons, polyolefins such as polypropylene filaments, polyethylene filaments, and biodegradable or compostable thermoplastic fibers such as polylactic acid filaments, polyhydroxyalkanoate filaments and polycaprolactone filaments. The filaments may be monocomponent or multicomponent, such as bicomponent filaments.

"Fiber Length", "Average Fiber Length" and "Weighted Average Fiber Length" are terms used interchangeably herein all intended to represent the "Length Weighted Average Fiber Length" as determined for example by means of a Kajaani FiberLab Fiber Analyzer commercially available from Metso Automation, Kajaani Finland. The instructions supplied with the unit detail the formula used to arrive at this average. The recommended method for measuring fiber length using this instrument is essentially the same as detailed by the manufacturer of the FiberLab in its operation manual. The recommended consistencies for charging to the FiberLab are somewhat lower than recommended by the manufacturer since this gives more reliable operation. Short fiber furnishes, as defined herein, should be diluted to 0.02-0.04% prior to charging to the instrument. Long fiber furnishes, as defined herein, should be diluted to 0.15%-0.30%. Alternatively, fiber length may be determined by sending the short fibers to a contract lab, such as Integrated Paper Services, Appleton, Wis.

Fibrous structures may be comprised of a combination of long fibers and short fibers.

Non-limiting examples of suitable long fibers for use in the present invention include fibers that exhibit an average fiber length of less than about 7 mm and/or less than about 5 mm and/or less than about 3 mm and/or less than about 2.5 mm and/or from about 1 mm to about 5 mm and/or from about 1.5 mm to about 3 mm and/or from about 1.8 mm to about 4 mm and/or from about 2 mm to about 3 mm.

Non-limiting examples of suitable short fibers suitable for use in the present invention include fibers that exhibit an average fiber length of less than about 5 mm and/or less than about 3 mm and/or less than about 1.2 mm and/or less than about 1.0 mm and/or from about 0.4 mm to about 5 mm and/or from about 0.5 mm to about 3 mm and/or from about 0.5 mm to about 1.2 mm and/or from about 0.6 mm to about 1.0 mm.

The individualized trichomes used in the present invention may include trichome fibers. The trichome fibers may be characterized as either long fibers or short fibers.

"Fibrous structure" as used herein means a structure that comprises one or more filaments and/or fibers. In one example, a fibrous structure according to the present invention means an orderly arrangement of filaments and/or fibers within a structure in order to perform a function. Non-limiting examples of fibrous structures of the present invention include paper, fabrics (including woven, knitted, and non-woven), and absorbent pads (for example for diapers or feminine hygiene products).

Non-limiting examples of processes for making fibrous structures include known wet-laid papermaking processes and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous slurry is then used to deposit a plurality of fibers onto a forming wire or belt such that an embryonic fibrous structure (also referred to an embryonic web) is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, and may subsequently be converted into a finished product, e.g. a sanitary tissue product.

Non-limiting types of fibrous structures according to the present invention include conventionally felt-pressed fibrous structures; pattern densified fibrous structures; and high-bulk, uncompacted fibrous structures. The fibrous structures may be of a homogenous or multilayered (two or three or more layers) construction; and the sanitary tissue products made therefrom may be of a single-ply or multi-ply construction.

In one example, the fibrous structure of the present invention is a pattern densified fibrous structure characterized by having a relatively high-bulk region of relatively low fiber density and an array of densified regions of relatively high fiber density. The high-bulk field is characterized as a field of pillow regions. The densified zones are referred to as knuckle regions. The knuckle regions exhibit greater density than the pillow regions. The densified zones may be discretely spaced within the high-bulk field or may be interconnected, either fully or partially, within the high-bulk field. Typically, from about 8% to about 65% of the fibrous structure surface comprises densified knuckles, the knuckles may exhibit a relative density of at least 125% of the density of the high-bulk field. Processes for making pattern densified fibrous structures are well known in the art as exemplified in U.S. Pat. Nos. 3,301,746, 3,974,025, 4,191,609 and 4,637,859.

The fibrous structures comprising a trichome in accordance with the present invention may be in the form of through-air-dried fibrous structures, differential density fibrous structures, differential basis weight fibrous structures, wet laid fibrous structures, air laid fibrous structures (examples of which are described in U.S. Pat. Nos. 3,949,035 and 3,825,381), conventional dried fibrous structures, creped or uncreped fibrous structures, patterned-densified or non-patterned-densified fibrous structures, compacted or uncompacted fibrous structures, nonwoven fibrous structures comprising synthetic or multicomponent fibers, homogeneous or multilayered fibrous structures, double re-creped fibrous structures, foreshortened fibrous structures, co-formed fibrous structures (examples of which are described in U.S. Pat. No. 4,100,324) and mixtures thereof.

In one example, the air laid fibrous structure is selected from the group consisting of thermal bonded air laid (TBAL) fibrous structures, latex bonded air laid (LBAL) fibrous structures and mixed bonded air laid (MBAL) fibrous structures.

The fibrous structures may exhibit a substantially uniform density or may exhibit differential density regions, in other words regions of high density compared to other regions within the patterned fibrous structure. Typically, when a fibrous structure is not pressed against a cylindrical dryer, such as a Yankee dryer, while the fibrous structure is still wet and supported by a through-air-drying fabric or by another fabric or when an air laid fibrous structure is not spot bonded, the fibrous structure typically exhibits a substantially uniform density.

The fibrous structures of the present invention may be homogeneous or may be layered. If layered, the fibrous structures may comprise at least two and/or at least three and/or at least four and/or at least five layers. In one example, a layered fibrous structure according to the present invention comprises at least one outer layer that comprises hardwood pulp fibers and/or about 100% by weight of the total fibers within the outer layer of hardwood pulp fibers.

In one example, the fibrous structure of the present invention may comprise two or more regions that exhibit different densities. In another example, the fibrous structure of the present invention may exhibit substantially uniform density.

In another example, the fibrous structure of the present invention may exhibit one or more embossments.

The fibrous structures of the present invention may be co-formed fibrous structures.

"Co-formed fibrous structure" as used herein means that the fibrous structure comprises a mixture of at least two different materials wherein at least one of the materials comprises a filament, such as a polypropylene filament, and at least one other material, different from the first material, comprises a solid additive, such as a fiber and/or a particulate. In one example, a co-formed fibrous structure comprises solid additives, such as fibers, such as wood pulp fibers, and filaments, such as polypropylene filaments.

"Solid additive" as used herein means a fiber and/or a particulate.

"Particulate" as used herein means a granular substance or powder.

"Sanitary tissue product" as used herein means a soft, low density (i.e. <about 0.15 g/cm$^3$) web useful as a wiping implement for post-urinary and post-bowel movement cleaning (toilet tissue), for otorhinolaryngological discharges (facial tissue), and multi-functional absorbent and cleaning uses (absorbent towels). The sanitary tissue product may be convolutedly wound upon itself about a core or without a core to form a sanitary tissue product roll.

In one example, the sanitary tissue product of the present invention comprises a fibrous structure according to the present invention.

The sanitary tissue products and/or fibrous structures of the present invention may exhibit a basis weight of greater than 15 g/m$^2$ (9.2 lbs/3000 ft$^2$) to about 120 g/m$^2$ (73.8 lbs/3000 ft$^2$) and/or from about 15 g/m$^2$ (9.2 lbs/3000 ft$^2$) to about 110 g/m$^2$ (67.7 lbs/3000 ft$^2$) and/or from about 20 g/m$^2$ (12.3 lbs/3000 ft$^2$) to about 100 g/m$^2$ (61.5 lbs/3000 ft$^2$) and/or from about 30 (18.5 lbs/3000 ft$^2$) to 90 g/m$^2$ (55.4 lbs/3000 ft$^2$). In addition, the sanitary tissue products and/or fibrous structures of the present invention may exhibit a basis weight between about 40 g/m$^2$ (24.6 lbs/3000 ft$^2$) to about 120 g/m$^2$ (73.8 lbs/3000 ft$^2$) and/or from about 50 g/m$^2$ (30.8 lbs/3000 ft$^2$) to about 110 g/m$^2$ (67.7 lbs/3000 ft$^2$) and/or from about 55 g/m$^2$ (33.8 lbs/3000 ft$^2$) to about 105 g/m$^2$ (64.6 lbs/3000 ft$^2$) and/or from about 60 g/m$^2$ (36.9 lbs/3000 ft$^2$) to 100 g/m$^2$ (61.5 lbs/3000 ft$^2$).

The sanitary tissue products of the present invention may exhibit a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in). In addition, the sanitary tissue product of the present invention may exhibit a total dry tensile strength of greater than about 196 g/cm (500 g/in) and/or from about 196 g/cm (500 g/in) to about 394 g/cm (1000 g/in) and/or from about 216 g/cm (550 g/in) to about 335 g/cm (850 g/in) and/or from about 236 g/cm (600 g/in) to about 315 g/cm (800 g/in). In one example, the sanitary tissue product exhibits a total dry tensile strength of less than about 394 g/cm (1000 g/in) and/or less than about 335 g/cm (850 g/in).

In another example, the sanitary tissue products of the present invention may exhibit a total dry tensile strength of greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 315 g/cm (800 g/in) to about 1968 g/cm (5000 g/in) and/or from about 354 g/cm (900 g/in) to about 1181 g/cm (3000 g/in) and/or from about 354 g/cm (900 g/in) to about 984 g/cm (2500 g/in) and/or from about 394 g/cm (1000 g/in) to about 787 g/cm (2000 g/in).

The sanitary tissue products of the present invention may exhibit an initial total wet tensile strength of less than about 78 g/cm (200 g/in) and/or less than about 59 g/cm (150 g/in) and/or less than about 39 g/cm (100 g/in) and/or less than about 29 g/cm (75 g/in).

The sanitary tissue products of the present invention may exhibit an initial total wet tensile strength of greater than about 118 g/cm (300 g/in) and/or greater than about 157 g/cm (400 g/in) and/or greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 118 g/cm (300 g/in) to about 1968 g/cm (5000 g/in) and/or from about 157 g/cm (400 g/in) to about 1181 g/cm (3000 g/in) and/or from about 196 g/cm (500 g/in) to about 984 g/cm (2500 g/in) and/or from about 196 g/cm (500 g/in) to about 787 g/cm (2000 g/in) and/or from about 196 g/cm (500 g/in) to about 591 g/cm (1500 g/in).

The sanitary tissue products of the present invention may exhibit a density (measured at 95 g/in$^2$) of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The sanitary tissue products of the present invention may be in the form of sanitary tissue product rolls. Such sanitary tissue product rolls may comprise a plurality of connected, but perforated sheets of fibrous structure, that are separably dispensable from adjacent sheets. In another example, the sanitary tissue products of the present invention may comprise discrete sheets that may be stacked together interleaved or not and/or dispensed from a container as individual sheets during use by a consumer.

The sanitary tissue products of the present invention may comprises additives such as softening agents, wet strength agents (such as temporary wet strength agents and/or permanent wet strength agents), bulk softening agents, lotions, silicones, wetting agents, latexes, especially surface-pattern-applied latexes, dry strength agents such as carboxymethylcellulose and starch, creping adhesives, and other types of additives suitable for inclusion in and/or on sanitary tissue products.

"Weight average molecular weight" as used herein means the weight average molecular weight as determined using gel permeation chromatography according to the protocol found in Colloids and Surfaces A. Physico Chemical & Engineering Aspects, Vol. 162, 2000, pg. 107-121.

"Basis Weight" as used herein is the weight per unit area of a sample reported in lbs/3000 ft$^2$ or g/m$^2$ and is measured according to the Basis Weight Test Method described herein.

"Machine Direction" or "MD" as used herein means the direction parallel to the flow of the fibrous structure through the fibrous structure making machine and/or sanitary tissue product manufacturing equipment.

"Cross Machine Direction" or "CD" as used herein means the direction parallel to the width of the fibrous structure making machine and/or sanitary tissue product manufacturing equipment and perpendicular to the machine direction.

"Ply" as used herein means an individual, integral fibrous structure.

"Plies" as used herein means two or more individual, integral fibrous structures disposed in a substantially contiguous, face-to-face relationship with one another, forming a multi-ply fibrous structure and/or multi-ply sanitary tissue product. It is also contemplated that an individual, integral fibrous structure can effectively form a multi-ply fibrous structure, for example, by being folded on itself.

"Surface pattern" with respect to a fibrous structure and/or sanitary tissue product in accordance with the present invention means herein a pattern that is present on at least one surface of the fibrous structure and/or sanitary tissue product. The surface pattern may be a textured surface pattern such that the surface of the fibrous structure and/or sanitary tissue product comprises protrusions and/or depressions as part of the surface pattern. For example, the surface pattern may comprise line elements and/or embossments. The surface pattern may be a non-textured surface pattern such that the surface of the fibrous structure and/or sanitary tissue product does not comprise protrusions and/or depressions as part of the surface pattern. For example, the surface pattern may be printed on a surface of the fibrous structure and/or sanitary tissue product.

Figure 14:
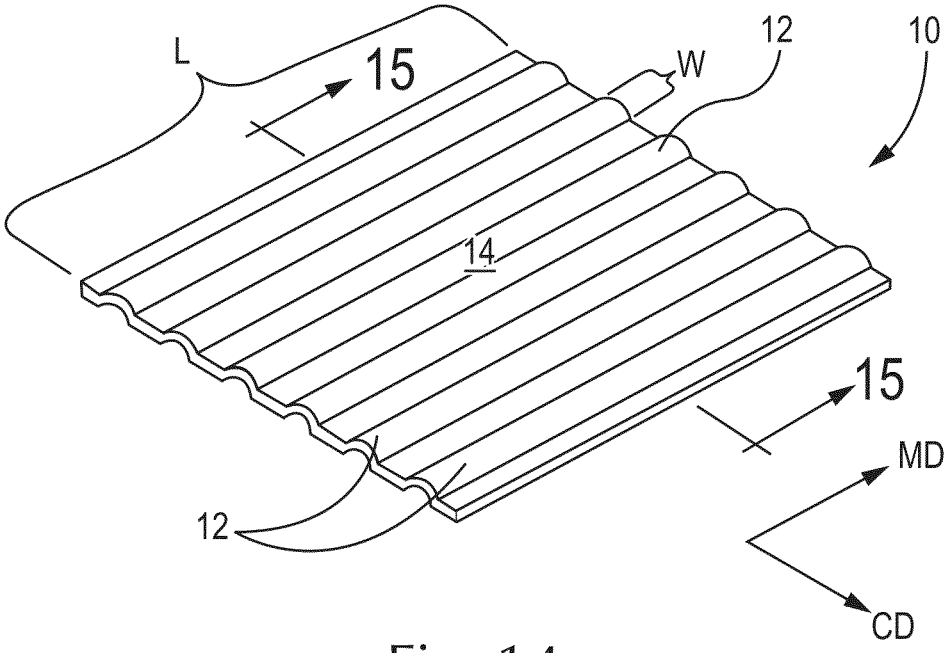
FIG. 14 is a schematic representation of an example of a fibrous structure in accordance with the present invention.

"Line element" as used herein means a discrete portion of a fibrous structure being deformed out-of-plane of the fibrous structure and having a three-dimensional topography that is imparted during the wet forming process portion of the fibrous structure making process (i.e., a line element is wet textured). The line element can have a linear dimension and an aspect ratio (i.e., length L to width W ratio as indicated in FIG. 14) of greater than 1.5:1 and/or greater than 1.75:1 and/or greater than 2:1 and/or greater than 5:1. In one non-limiting example, the line element exhibits a length of at least 2 mm and/or at least 4 mm and/or at least 6 mm and/or at least 1 cm to about 30 cm and/or to about 27 cm and/or to about 20 cm and/or to about 15 cm and/or to about 10.16 cm and/or to about 8 cm and/or to about 6 cm and/or to about 4 cm. The line element may be of any suitable shape, such as straight or curvilinear and mixtures thereof as shown for example in FIG. 21.

Different line elements may exhibit different common intensive properties. For example, different line elements may exhibit different densities and/or basis weights. In one example, a fibrous structure of the present invention comprises a first group of first line elements and a second group of second line elements. The first group of first line elements may exhibit the same densities, which are lower than the densities of second line elements in a second group.

In one example, the line element is a straight or substantially straight line element. In another example, the line element is a curvilinear line element, such as a sinusoidal line element. Unless otherwise stated, the line elements of the present invention are present on a surface of a fibrous structure. The length and/or width and/or height of the line elements of the present invention can be determined by measuring, or at least closely approximate, the length and/or width and/or height (respectively) of the portion of the molding member, such as a deflection conduit, or other structure that imparts the line element to the fibrous structure. Likewise, because of the close approximation in dimensions, the molding member may be provided with a particular set of dimensions in order to impart a line element with similar dimensions to the fibrous structure.

In one example, the line element and/or the portion of the molding member or other structure that imparts the line element to a fibrous structure is continuous or substantially continuous within a useable fibrous structure and/or sanitary tissue product, for example in one case, one or more 21.5 cm×21.5 cm sheets of fibrous structure and/or sanitary tissue product. The line elements may exhibit different widths along their lengths, between two or more different line elements and/or the line elements may exhibit different lengths. Different line elements may exhibit different widths and/or lengths.

In one example, the surface pattern of the present invention comprises a plurality of parallel line elements. The plurality of parallel line elements may be a series of parallel line elements. In one example, the plurality of parallel line elements may comprise a plurality of parallel sinusoidal line elements.

In one example, the line elements are water-resistant.

"Water-resistant" as it refers to a surface pattern or part thereof means that a line element and/or pattern comprising the line element retains all or much of its structure and/or integrity after being saturated by water and the line element and/or pattern is still visible to a consumer. In one example, the line elements and/or surface pattern may be water-resistant.

"Embossed" as used herein with respect to a fibrous structure and/or sanitary tissue product means that a fibrous structure and/or sanitary tissue product has been subjected to a process which converts a smooth surfaced fibrous structure and/or sanitary tissue product to a decorative surface by replicating a design on one or more emboss rolls, which form a nip through which the fibrous structure and/or sanitary tissue product passes. Embossed does not include wet texturing, as described herein, or creping, microcreping, printing or other processes that may also impart a texture and/or decorative pattern to a fibrous structure and/or sanitary tissue product.

"Average distance" as used herein with reference to the average distance between two line elements is the average of the distances measured between the centers of two immediately adjacent line elements measured along their respective lengths. Obviously, if one of the line elements extends further than the other, the measurements would stop at the ends of the shorter line element.

"Discrete" as it refers to a line element means that a line element has at least one immediate adjacent region of the fibrous structure that is different from the line element. In one example, a plurality of parallel line elements comprises discrete line elements and/or line elements that are separated from adjacent parallel line elements by a channel. The channel may exhibit a complementary shape to the parallel line elements. In other words, if the plurality of parallel line elements are straight lines, then the channels separating the parallel line elements would be straight. Likewise, if the plurality of parallel line elements are sinusoidal lines, then the channels separating the parallel line elements would be sinusoidal. The channels may exhibit the same widths and/or lengths as the line elements.

"Unidirectional" as it refers to a line element means that along the length of the line element, the line element does not exhibit a directional vector that contradicts the line element's major directional vector.

"Uninterrupted" as it refers to a line element means that a line element does not have a region that is different from the line element cutting across the line element along its length. Undulations within a line element such as those resulting from operations such creping and/or foreshortening are not considered to result in regions that are different from the line element and thus do not interrupt the line element along its length.

"Substantially machine direction (MD) oriented" as it refers to a line element means that the total length of the line element that is positioned at an angle of greater than 45° relative to the cross machine direction is greater than the total length of the line element that is positioned at an angle of 45° or less relative to the cross machine direction.

"Substantially cross machine direction (CD) oriented" as it refers to a line element means that the total length of the line element that is positioned at an angle of 45° or greater relative to the machine direction is greater than the total length of the line element that is positioned at an angle of less than 45° relative to the machine direction.

"Wet textured" as used herein means that a fibrous structure comprises texture (for example a three-dimensional topography) imparted to the fibrous structure and/or fibrous structure's surface during a fibrous structure making process. In one example, in a wet-laid fibrous structure making process, wet texture can be imparted to a fibrous structure upon fibers and/or filaments being collected on a collection device that has a three-dimensional (3D) surface which imparts a 3D surface to the fibrous structure being formed thereon and/or being transferred to a fabric and/or belt, such as a through-air-drying fabric and/or a patterned drying belt, comprising a 3D surface that imparts a 3D surface to a fibrous structure being formed thereon. In one example, the collection device with a 3D surface comprises a pattern, such as a pattern formed by a polymer or resin being deposited onto a base substrate, such as a fabric, in a patterned configuration. The wet texture imparted to a wet-laid fibrous structure is formed in the fibrous structure prior to and/or during drying of the fibrous structure. Non-limiting examples of collection devices and/or fabric and/or belts suitable for imparting wet texture to a fibrous structure include those fabrics and/or belts used in fabric creping and/or belt creping processes, for example as disclosed in U.S. Pat. Nos. 7,820,008 and 7,789,995, coarse through-air-drying fabrics as used in uncreped through-air-drying processes, and photo-curable resin patterned through-air-drying belts, for example as disclosed in U.S. Pat. No. 4,637,859. For purposes of the present invention, the collection devices used for imparting wet texture to the fibrous structures could be patterned to result in the fibrous structures comprising a surface pattern comprising a plurality of parallel line elements wherein at least one, two, three, or more, for example all of the parallel line elements exhibit a non-constant width along the length of the parallel line elements. This is different from non-wet texture that is imparted to a fibrous structure after the fibrous structure has been dried, for example after the moisture level of the fibrous structure is less than 15% and/or less than 10% and/or less than 5%. An example of non-wet texture includes embossments imparted to a fibrous structure by embossing rolls during converting of the fibrous structure.

"Non-rolled" as used herein with respect to a fibrous structure and/or sanitary tissue product of the present invention means that the fibrous structure and/or sanitary tissue product is an individual sheet (for example not connected to adjacent sheets by perforation lines even though, two or more individual sheets may be interleaved with one another) that is not convolutedly wound about a core or itself. For example, a non-rolled product comprises a facial tissue.

Trichomes

Essentially all plants have trichomes. Those skilled in the art will recognize that some plants will have trichomes of sufficient mass fraction and/or the overall growth rate and/or robustness of the plant so that they may offer attractive agricultural economy to make them more suitable for a large commercial process, such as using them as a source of chemicals, e.g. cellulose, or assembling them into fibrous structures, such as disposable fibrous structures. Trichomes may have a wide range of morphology and chemical properties. For example, the trichomes may be in the form of fibers; namely, trichome fibers. Such trichome fibers may have a high length to diameter ratio.

The following sources are offered as non-limiting examples of trichome-bearing plants (suitable sources) for obtaining trichomes, especially trichome fibers.

Non-limiting examples of suitable sources for obtaining trichomes, especially trichome fibers, are plants in the Labiatae (Lamiaceae) family commonly referred to as the mint family.

Examples of suitable species in the Labiatae family include *Stachys byzantina*, also known as *Stachys lanata* commonly referred to as lamb's ear, woolly betony, or woundwort. The term *Stachys byzantina* as used herein also includes cultivars *Stachys byzantina* 'Primrose Heron', *Stachys byzantina* 'Helene von Stein' (sometimes referred to as *Stachys byzantina* 'Big Ears'), *Stachys byzantina* 'Cotton Boll', *Stachys byzantina* 'Variegated' (sometimes referred to as *Stachys byzantina* 'Striped Phantom'), and *Stachys byzantina* 'Silver Carpet'.

Additional examples of suitable species in the Labiatae family include the *arcticus* subspecies of *Thymus praecox*, commonly referred to as creeping thyme and the *pseudolanuginosus* subspecies of *Thymus praecox*, commonly referred to as wooly thyme.

Further examples of suitable species in the Labiatae family include several species in the genus *Salvia* (sage), including *Salvia leucantha*, commonly referred to as the Mexican bush sage; *Salvia tarahumara*, commonly referred to as the grape scented Indian sage; *Salvia apiana*, commonly referred to as white sage; *Salvia funereal*, commonly referred to as Death Valley sage; *Salvia sagittata*, commonly referred to as balsamic sage; and *Salvia argentiae*, commonly referred to as silver sage.

Even further examples of suitable species in the Labiatae family include *Lavandula lanata*, commonly referred to as wooly lavender; *Marrubium vulgare*, commonly referred to as horehound; *Plectranthus argentatus*, commonly referred to as silver shield; and *Plectranthus tomentosa.*

Non-limiting examples of other suitable sources for obtaining trichomes, especially trichome fibers are plants in the Asteraceae family commonly referred to as the sunflower family.

Examples of suitable species in the Asteraceae family include *Artemisia stelleriana*, also known as silver brocade; *Haplopappus macronema*, also known as the whitestem goldenbush; *Helichrysum petiolare; Centaurea maritime*, also known as *Centaurea gymnocarpa* or dusty miller; *Achillea tomentosum*, also known as wooly yarrow; *Anaphalis margaritacea*, also known as pearly everlasting; and *Encelia farinose*, also known as brittle bush.

Additional examples of suitable species in the Asteraceae family include *Senecio brachyglottis* and *Senecio haworthii*, the latter also known as *Kleinia haworthii.*

Non-limiting examples of other suitable sources for obtaining trichomes, especially trichome fibers, are plants in the Scrophulariaceae family commonly referred to as the figwort or snapdragon family.

An example of a suitable species in the Scrophulariaceae family includes *Pedicularis kanei*, also known as the wooly lousewort.

Additional examples of suitable species in the Scrophulariaceae family include the mullein species (*Verbascum*) such as *Verbascum hybridium*, also known as snow maiden; *Verbascum thapsus*, also known as common mullein; *Verbascum baldaccii; Verbascum bombyciferum; Verbascum broussa; Verbascum chaixii; Verbascum dumulsum; Verbascum lacin-*

*iatum; Verbascum lanatum; Verbascum longifolium; Verbascum lychnitis; Verbascum olympicum; Verbascum paniculatum; Verbascum phlomoides; Verbascum phoeniceum; Verbascum speciosum; Verbascum thapsiforme; Verbascum virgatum; Verbascum wiedemannianum*; and various mullein hybrids including *Verbascum* 'Helen Johnson' and *Verbascum* 'Jackie'.

Further examples of suitable species in the Scrophulariaceae family include *Stemodia tomentosa* and *Stemodia durantifolia.*

Non-limiting examples of other suitable sources for obtaining trichomes, especially trichome fibers include *Greyia radlkoferi* and *Greyia flanmaganii* plants in the Greyiaceae family commonly referred to as the wild bottlebrush family.

Non-limiting examples of other suitable sources for obtaining trichomes, especially trichome fibers include members of the Fabaceae (legume) family. These include the *Glycine max*, commonly referred to as the soybean, and *Trifolium pratense* L, commonly referred to as medium and/or mammoth red clover.

Non-limiting examples of other suitable sources for obtaining trichomes, especially trichome fibers include members of the Solanaceae family including varieties of *Lycopersicum esculentum*, otherwise known as the common tomato.

Non-limiting examples of other suitable sources for obtaining trichomes, especially trichome fibers include members of the Convolvulaceae (morning glory) family, including *Argyreia nervosa*, commonly referred to as the wooly morning glory and *Convolvulus cneorum*, commonly referred to as the bush morning glory.

Non-limiting examples of other suitable sources for obtaining trichomes, especially trichome fibers include members of the Malvaceae (mallow) family, including *Anoda cristata*, commonly referred to as spurred anoda and *Abutilon theophrasti*, commonly referred to as velvetleaf.

Non-limiting examples of other suitable sources for obtaining trichomes, especially trichome fibers include *Buddleia marrubiifolia*, commonly referred to as the wooly butterfly bush of the Loganiaceae family; the *Casimiroa tetrameria*, commonly referred to as the wooly leafed sapote of the Rutaceae family; the *Ceanothus tomentosus*, commonly referred to as the wooly leafed mountain liliac of the Rhamnaceae family; the 'Philippe Vapelle' cultivar of *renardii* in the Geraniaceae (geranium) family; the *Tibouchina urvilleana*, commonly referred to as the Brazilian spider flower of the Melastomataceae family; the *Tillandsia recurvata*, commonly referred to as ballmoss of the Bromeliaceae (pineapple) family; the *Hypericum tomentosum*, commonly referred to as the wooly St. John's wort of the Hypericaceae family; the *Chorizanthe orcuttiana*, commonly referred to as the San Diego spineflower of the Polygonaceae family; *Eremocarpus setigerus*, commonly referred to as the doveweed of the Euphorbiaceae or spurge family; *Kalanchoe tomentosa*, commonly referred to as the panda plant of the Crassulaceae family; and *Cynodon dactylon*, commonly referred to as Bermuda grass, of the Poaceae family; and *Congea tomentosa*, commonly referred to as the shower orchid, of the Verbenaceae family.

Suitable trichome-bearing plants are commercially available from nurseries and other plant-selling commercial venues. For example, *Stachys byzantina* may be purchased and/or viewed at Blanchette Gardens, Carlisle, Mass.

The trichome-bearing material may be subjected to a mechanical process to liberate its trichomes from its plant epidermis to enrich the pulp or fiber mass' content of individualized trichomes. This may be carried out by means of screening or air classifying equipment well known in the art. A suitable air classifier is the Hosokawa Alpine 50ATP, sold by Hosokawa Micron Powder Systems of Summit, N.J. Other suitable classifiers are available from the Minox Siebtechnik.

In one example, a trichome suitable for use in the fibrous structures of the present invention comprises cellulose.

In yet another example, a trichome suitable for use in the fibrous structures of the present invention comprises a fatty acid.

In still another example, a trichome suitable for use in the fibrous structures of the present invention is hydrophobic.

In yet another example, a trichome suitable for use in the fibrous structures of the present invention is less hydrophilic than softwood fibers. This characteristic of the trichome may facilitate a reduction in drying temperatures needed to dry fibrous structures comprising such trichome and/or may facilitate making the fibrous structures containing such trichome at a faster rate.

Figure 2:
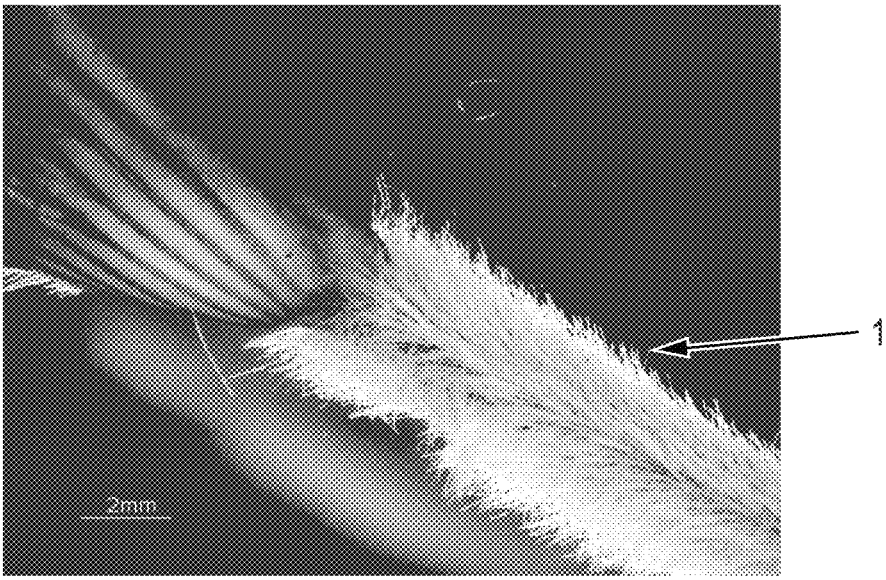
FIG. 2 is a light micrograph of a lower stem illustrating trichomes present on red clover, *Trifolium pratense* L.

As shown in FIG. 1, numerous trichomes 1 are present on this red clover leaf and leaf stem. FIG. 2 shows numerous trichomes 1 present on a red clover lower stem.

Figure 3:
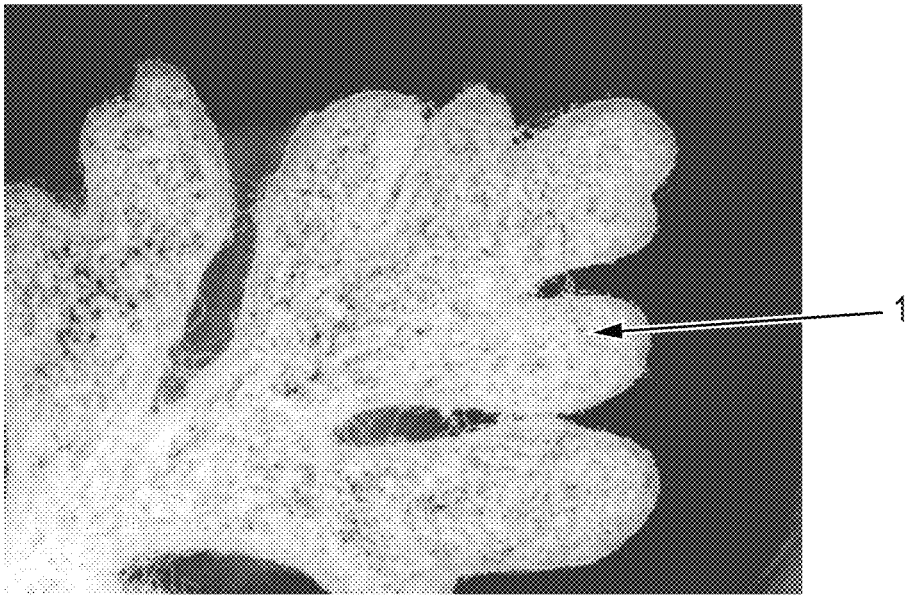
FIG. 3 is a light micrograph of a leaf illustrating trichomes present on dusty miller, *Centaurea gymnocarpa;*
Figure 4:
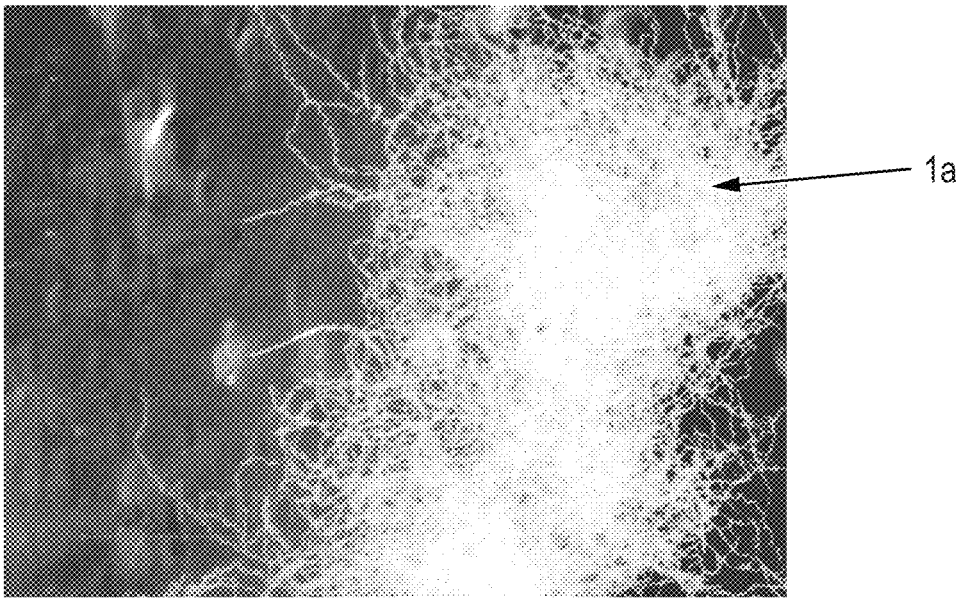
FIG. 4 is a light micrograph of individualized trichomes individualized from a leaf of dusty miller, *Centaurea gymnocarpa;*

As shown in FIG. 3, a dusty miller leaf is contains numerous trichomes 1. FIG. 4 shows individualized trichomes 1*a* obtained from a dusty miller leaf.

Figure 5:
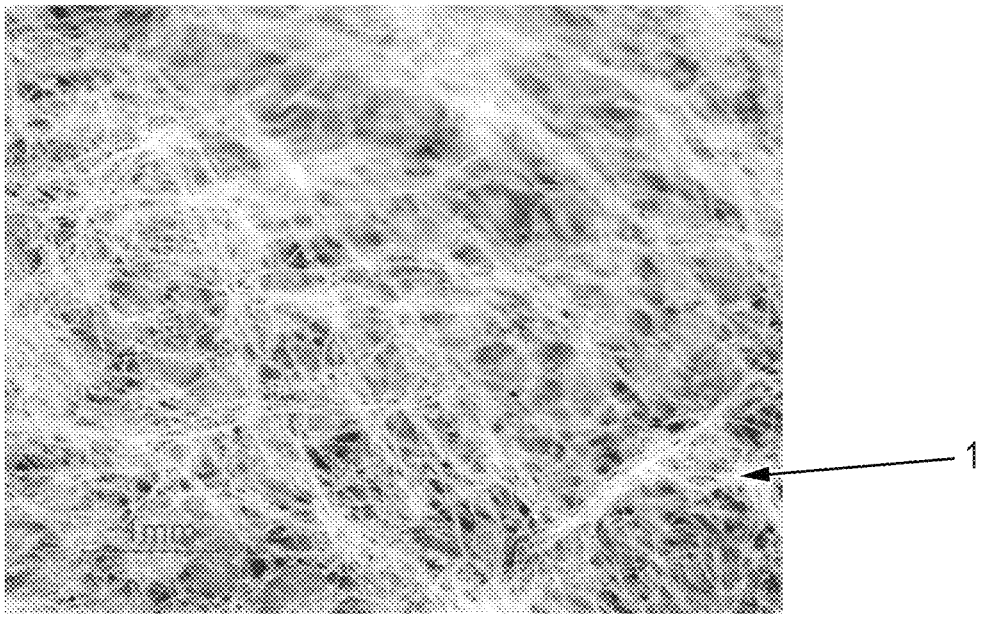
FIG. 5 is a light micrograph of a basal leaf illustrating trichomes present on silver sage, *Salvia argentiae;*
Figure 6:
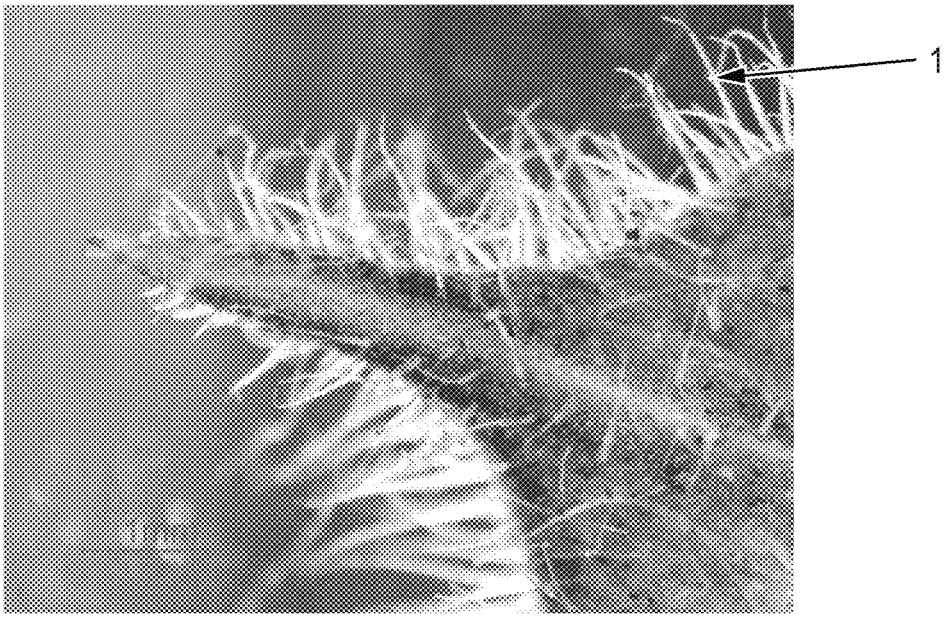
FIG. 6 is a light micrograph of a bloom-stalk leaf illustrating trichomes present in silver sage, *Salvia argentiae;*

As shown in FIG. 5, a basal leaf on a silver sage contains numerous trichomes 1. FIG. 6 shows trichomes 1 present on a bloom-stalk leaf of a silver sage.

Figure 7:
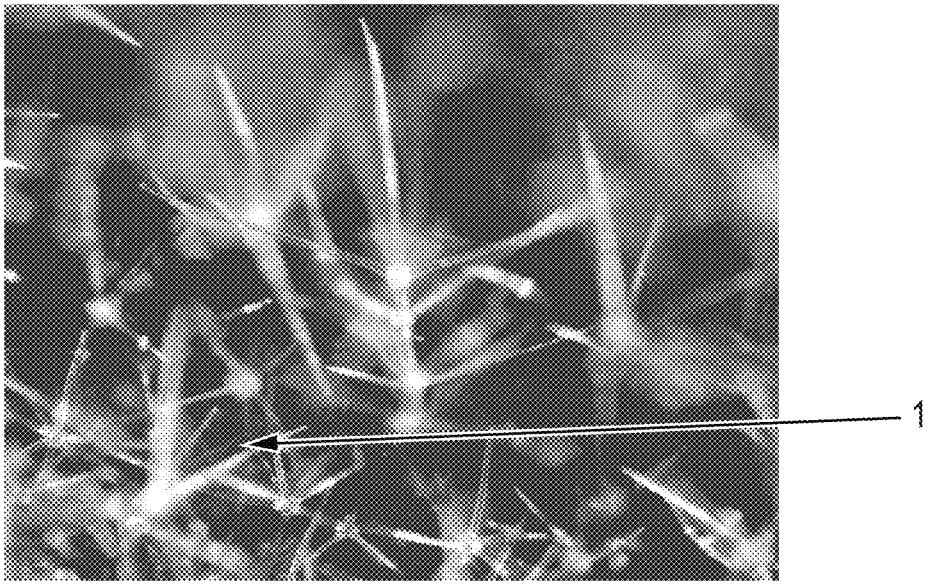
FIG. 7 is a light micrograph of a mature leaf illustrating trichomes present on common mullein, *Verbascum thapsus;*
Figure 8:
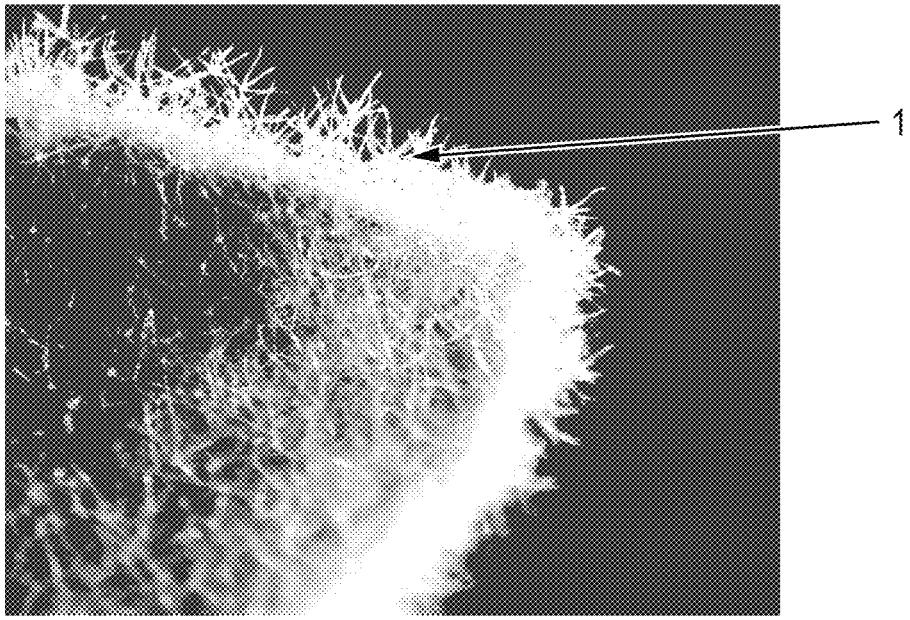
FIG. 8 is a light micrograph of a juvenile leaf illustrating trichomes present on common mullein, *Verbascum thapsus;*

As shown in FIG. 7, trichomes 1 are present on a mature leaf of common mullein. FIG. 8 shows trichomes 1 present on a juvenile leaf of common mullein.

Figure 9:
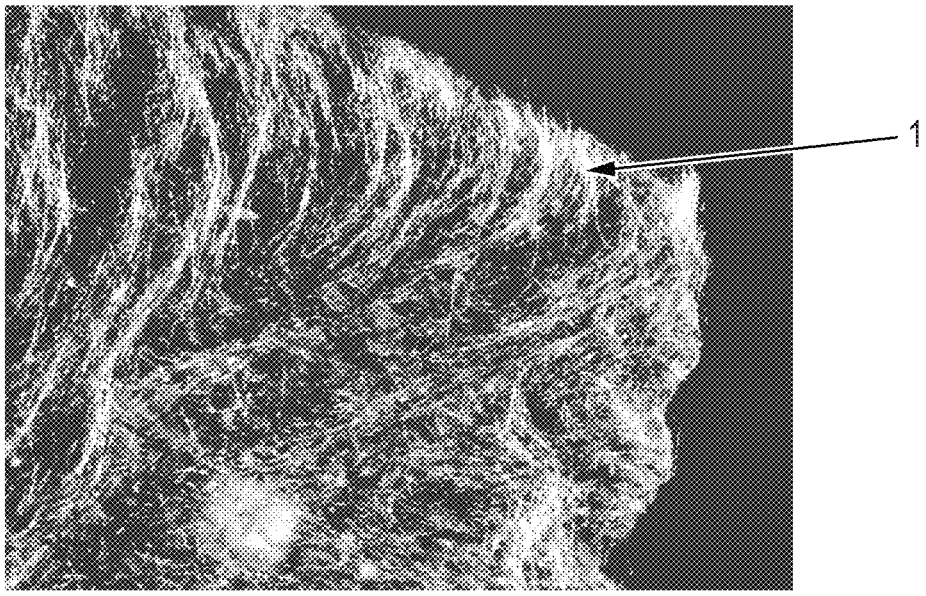
FIG. 9 is a light micrograph of a perpendicular view of a leaf illustrating trichomes present on wooly betony, *Stachys byzantina;*
Figure 10:
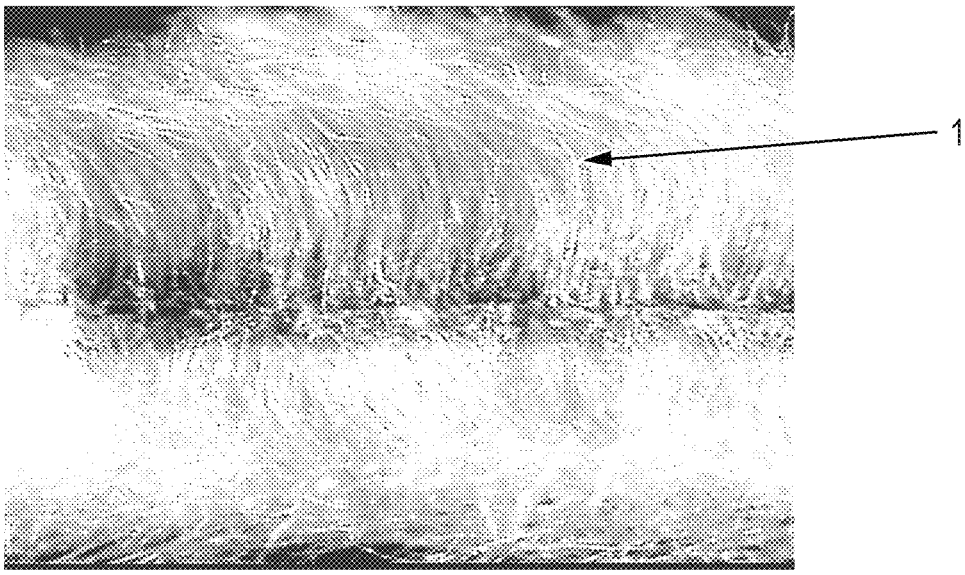
FIG. 10 is a light micrograph of a cross-sectional view of a leaf illustrating trichomes present on wooly betony, *Stachys byzantina;*
Figure 11:
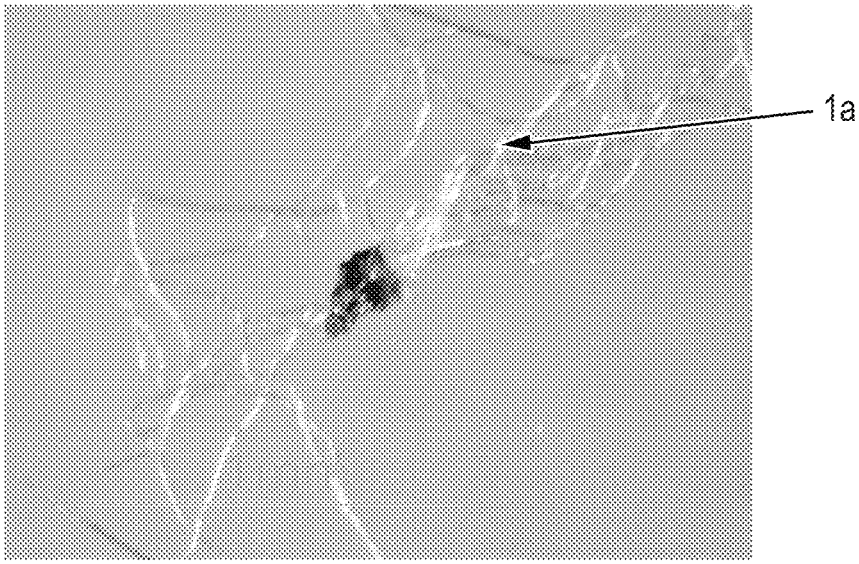
FIG. 11 is a light micrograph of individualized trichomes in the form of a plurality of trichomes bound by their individual attachment to a common remnant of a host plant, wooly betony, *Stachys byzantine;*

FIG. 9 shows, via a perpendicular view, trichomes 1 present on a leaf of wooly betony. FIG. 10 is a cross-sectional view of a leaf of wooly betony containing trichomes 1. FIG. 11 shows individualized trichomes 1*a* obtained from a wooly betony leaf.

Table 1 below shows a comparison of fiber morphology for a hardwood fiber (Eucalyptus pulp fiber), a softwood fiber (NSK pulp fiber) and a representative example of a trichome fiber.

TABLE 1

| Property | *Eucalyptus* Fiber | NSK Fiber | Trichome Fiber |
|---|---|---|---|
| Fiber Length (mm) | 0.76 | 2.18 | 1.352 |
| Fiber Width (μm) | 19.1 | 27.6 | 18.1 |
| Coarseness (mg/m) | 0.0895 | 0.1386 | 0.0995 |
| Bendability | 3.4 | 6.4 | 0.5 |
| Kinks/mm | 0.82 | 0.47 | 0.77 |
| Kajaani Cell Wall | 6.6 | 9.6 | 6.44 |

As is evident from Table 1, trichome fibers are greater in length than Eucalyptus fibers, but shorter than NSK fibers. However, other properties of trichome fibers are more closely associated with properties of Eucalyptus fibers than to NSK fibers.

Fibrous Structure

The fibrous structures of the present invention may be a single-ply or multi-ply fibrous structure.

The fibrous structures of the present invention may comprise greater than 50% and/or greater than 75% and/or greater than 90% and/or 100% or less by weight on a dry fiber basis of pulp fibers.

In one example, the fibrous structures of the present invention comprise less than 22% and/or less than 21% and/or less than 20% and/or less than 19% and/or less than 18% and/or to about 5% and/or to about 7% and/or to about 10% and/or to about 12% and/or to about 15% by weight on a dry fiber basis of softwood fibers.

In one example, the fibrous structures of the present invention may exhibit a basis weight between about 10 $g/m^2$ to about 120 $g/m^2$ and/or from about 15 $g/m^2$ to about 110 $g/m^2$ and/or from about 20 $g/m^2$ to about 100 $g/m^2$ and/or from about 30 to 90 $g/m^2$. In addition, the sanitary tissue product of the present invention may exhibit a basis weight between about 40 $g/m^2$ to about 120 $g/m^2$ and/or from about 50 $g/m^2$ to about 110 $g/m^2$ and/or from about 55 $g/m^2$ to about 105 $g/m^2$ and/or from about 60 to 100 $g/m^2$ as measured according to the Basis Weight Test Method described herein.

In another example, the fibrous structures of the present invention may exhibit a basis weight of at least 21 $g/m^2$ and/or at least 23 $g/m^2$ and/or at least 25 $g/m^2$ as measured according to the Basis Weight Test Method described herein.

In yet another example, the fibrous structures of the present invention may comprise a plurality of pulp fibers derived from a pulp fiber-producing source that has a growing cycle of less than 800 and/or every 400 and/or every 200 and/or every 100 or less days.

The fibrous structures of the present invention may comprise one or more individualized trichomes, for example trichome fibers. In one example, a trichome fiber suitable for use in the fibrous structures of the present invention exhibit a fiber length of from about 100 μm to about 7000 μm and a width of from about 3 μm to about 30 μm.

In addition to a trichome, other fibers and/or other ingredients may also be present in the fibrous structures of the present invention.

Fibrous structures according to this invention may comprise more than about 0.1% to and/or from about 0.5% to about 90% and/or from about 0.5% to about 80% and/or from about 0.5% to about 50% and/or from about 1% to about 40% and/or from about 2% to about 30% and/or from about 5% to about 25% and/or from about 5% to about 15% by weight on a dry fiber basis of wood pulp fibers, such as hardwood pulp fibers and/or softwood pulp fibers.

In one example, the fibrous structures of the present invention comprise a mixture of trichomes and hardwood pulp fibers, such as eucalyptus fibers. In another example, the fibrous structures of the present invention are layered fibrous structures wherein at least one layer comprises a mixture of trichomes and hardwood pulp fibers, such a layer may comprise a consumer-contacting surface during use by a consumer.

In one example, the fibrous structures of the present invention are layered fibrous structures that comprise at least one outer layer (consumer-contacting surface) that comprises 100% by weight of the total fibers within the outer layer of trichomes and/or hardwood pulp fibers.

In another example, the fibrous structures of the present invention are homogeneous fibrous structures (not layered).

In addition to a trichome, the fibrous structure may comprise other additives, such as wet strength agents (permanent and/or temporary), softening additives, solid additives (such as starch, clays), dry strength resins, wetting agents, lint resisting and/or reducing agents, absorbency-enhancing agents, immobilizing agents, especially in combination with emollient lotion compositions, antiviral agents including organic acids, antibacterial agents, polyol polyesters, antimigration agents, polyhydroxy plasticizers and mixtures thereof. Such other additives may be added to the fiber furnish, the embryonic fibrous web and/or the fibrous structure.

Such other additives may be present in the fibrous structure at any suitable level based on the dry weight of the fibrous structure. In one nonlimiting example, the other additives may be present in the fibrous structure at a level of from about 0.001 to about 50% and/or from about 0.001 to about 20% and/or from about 0.01 to about 5% and/or from about 0.03 to about 3% and/or from about 0.1 to about 1.0% by weight, on a dry fibrous structure basis.

The fibrous structures of the present invention may be subjected to any suitable post processing including, but not limited to, printing, embossing, calendaring, slitting, folding, combining with other fibrous structures, and the like.

Figure 12:
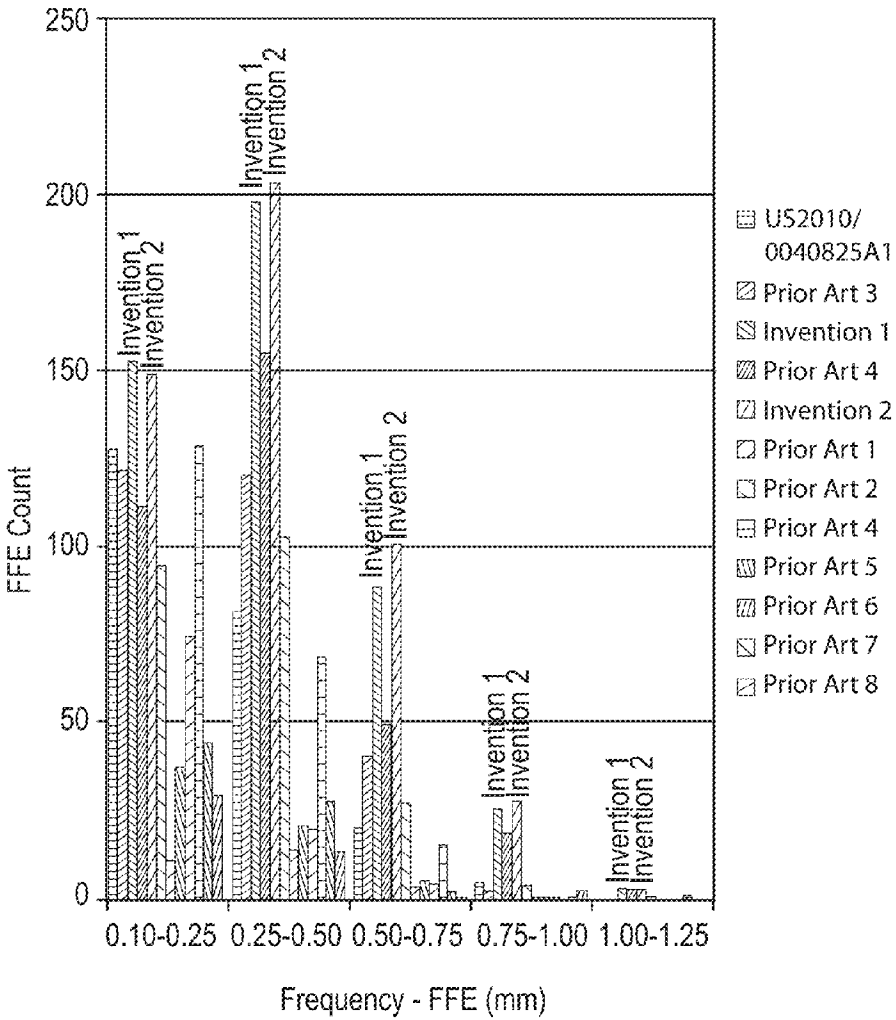
FIG. 12 is a graph showing the Free Fiber End Count for examples of a fibrous structure according to the present invention and five known fibrous structures.
Figure 13:
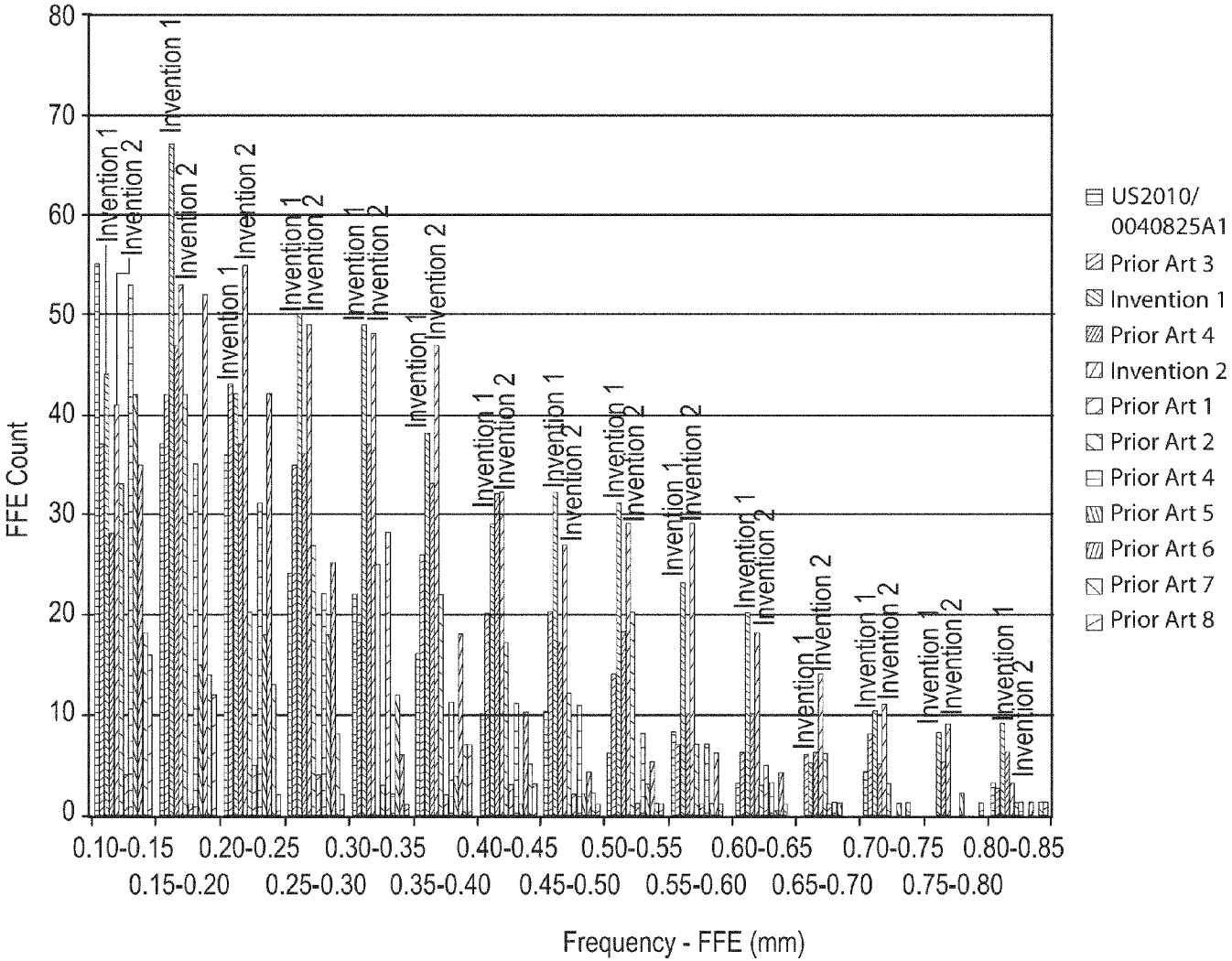
FIG. 13 is a graph showing the Free Fiber End Count data from FIG. 12 in smaller increments.

In one example of the present invention as shown in FIGS. 12 and 13, a fibrous structure according to the present invention exhibits a Free Fiber End Count of greater than 130 in the range of free fiber end lengths of from about 0.1 mm to about 0.25 mm as determined by the Free Fiber End Test Method. In other words, over 130 free fiber ends have a length between about 0.1 mm and about 0.25 mm as determined by the Free Fiber End Test Method.

In another example of the present invention as shown in FIG. 13, a fibrous structure according to the present invention exhibits a Free Fiber End Count of greater than 93 in the range of free fiber end lengths of from about 0.1 mm to about 0.20 mm as determined by the Free Fiber End Test Method.

In another example of the present invention as shown in FIGS. 12 and 13, a fibrous structure that exhibits a Free Fiber End Count of greater than 160 in the range of free fiber end lengths of from about 0.25 mm to about 0.50 mm as determined by the Free Fiber End Test Method is provided.

In another example of the present invention as shown in FIG. 13, a fibrous structure that exhibits a Free Fiber End Count of greater than 110 in the range of free fiber end lengths of from about 0.25 mm to about 0.40 mm as determined by the Free Fiber End Test Method is provided.

In still another example of the present invention as shown in FIG. 13, a fibrous structure that exhibits a Free Fiber End Count of greater than 80 in the range of free fiber end lengths of from about 0.25 mm to about 0.35 mm as determined by the Free Fiber End Test Method is provided.

In another example of the present invention as shown in FIGS. 12 and 13, a fibrous structure that exhibits a Free Fiber End Count of greater than 50 in the range of free fiber end lengths of from about 0.50 mm to about 0.75 mm as determined by the Free Fiber End Test Method is provided.

In another example of the present invention as shown in FIG. 13, a fibrous structure that exhibits a Free Fiber End Count of greater than 40 in the range of free fiber end lengths of from about 0.50 mm to about 0.65 mm as determined by the Free Fiber End Test Method is provided.

Tables 2 and 3 below set forth the Free Fiber End Counts for known fibrous structures and two examples of fibrous structures according to the present invention ("Invention 1" and "Invention 2"). As can be seen, Table 3 displays smaller free fiber end length ranges than Table 2, such that three columns of Table 3 can be summed to arrive at the values provided in one column of Table 2 (e.g., Table 2 provides a range of 0.10-0.25 while Table 3 provides ranges 0.10-0.15, 0.15-0.20 and 0.20-0.25; likewise, the sum of Free Fiber End Counts for each of the three subintervals in Table 3 equates to the Free Fiber End Count of the larger interval in Table 2). Additional information regarding the two examples of the present invention is provided below in the section entitled Non-Limiting Examples of Fibrous Structures of the Present Invention.

TABLE 2

| Free Fiber End (FFE) Counts | Free Fiber End (FFE) Length interval_mm 0.10-0.25 mm | Free Fiber End (FFE) Length interval_mm 0.25-0.50 mm | Free Fiber End (FFE) Length interval_mm 0.50-0.75 mm |
|---|---|---|---|
| US 2010/0040825A1 | 128 | 82 | 21 |
| Prior Art3 | 122 | 120 | 41 |
| Invention 1 | 153 | 198 | 89 |
| Prior Art4 | 112 | 155 | 49 |
| Invention 2 | 149 | 203 | 101 |

TABLE 2-continued

| | Free Fiber End (FFE) Length interval_mm | Free Fiber End (FFE) Length interval_mm | Free Fiber End (FFE) Length interval_mm |
|---|---|---|---|
| Prior Art1 | 95 | 103 | 28 |
| Prior Art2 | 11 | 14 | 4 |
| Prior Art4 | 38 | 21 | 6 |
| Prior Art5 | 75 | 20 | 5 |
| Prior Art6 | 129 | 69 | 16 |
| Prior Art7 | 45 | 28 | 3 |
| Prior Art8 | 30 | 14 | 1 |

TABLE 3

| Free Fiber End (FFE) Counts | Free Fiber End (FFE) Length interval_mm 0.10-0.15 mm | Free Fiber End (FFE) Length interval_mm 0.15-0.20 mm | Free Fiber End (FFE) Length interval_mm 0.20-0.25 mm | Free Fiber End (FFE) Length interval_mm 0.25-0.30 mm | Free Fiber End (FFE) Length interval_mm 0.30-0.35 mm | Free Fiber End (FFE) Length interval_mm 0.35-0.40 mm |
|---|---|---|---|---|---|---|
| US 2010/0040825A1 | 55 | 37 | 36 | 24 | 22 | 16 |
| Prior Art3 | 37 | 42 | 43 | 35 | 19 | 26 |
| Invention 1 | 44 | 67 | 42 | 50 | 49 | 38 |
| Prior Art4 | 28 | 47 | 37 | 36 | 37 | 33 |
| Invention 2 | 41 | 53 | 55 | 49 | 48 | 47 |
| Prior Art1 | 33 | 42 | 20 | 27 | 25 | 22 |
| Prior Art2 | 4 | 1 | 5 | 4 | 3 | 2 |
| Prior Art4 | 53 | 35 | 31 | 22 | 28 | 11 |
| Prior Art5 | 42 | 15 | 18 | 11 | 2 | 4 |
| Prior Art6 | 35 | 52 | 42 | 25 | 12 | 18 |
| Prior Art7 | 18 | 14 | 13 | 8 | 6 | 7 |
| Prior Art8 | 16 | 12 | 2 | 2 | 1 | 7 |

| Free Fiber End (FFE) Counts | Free Fiber End (FFE) Length interval_mm 0.40-0.45 mm | Free Fiber End (FFE) Length interval_mm 0.45-0.50 mm | Free Fiber End (FFE) Length interval_mm 0.50-0.55 mm | Free Fiber End (FFE) Length interval_mm 0.55-0.60 mm | Free Fiber End (FFE) Length interval_mm 0.60-0.65 mm |
|---|---|---|---|---|---|
| US 2010/0040825A1 | 10 | 10 | 6 | 8 | 3 |
| Prior Art3 | 20 | 20 | 14 | 7 | 6 |
| Invention 1 | 29 | 32 | 31 | 23 | 20 |
| Prior Art4 | 32 | 17 | 18 | 10 | 10 |
| Invention 2 | 32 | 27 | 29 | 29 | 18 |
| Prior Art1 | 17 | 12 | 9 | 7 | 3 |
| Prior Art2 | 3 | 2 | 1 | 1 | 1 |
| Prior Art4 | 11 | 11 | 8 | 7 | 3 |
| Prior Art5 | 1 | 2 | 3 | 1 | 0 |
| Prior Art6 | 10 | 4 | 5 | 6 | 4 |
| Prior Art7 | 5 | 2 | 1 | 1 | 1 |
| Prior Art8 | 3 | 1 | 1 | 0 | 0 |

| Free Fiber End (FFE) Counts | Free Fiber End (FFE) Length interval_mm 0.65-0.70 mm | Free Fiber End (FFE) Length interval_mm 0.70-0.75 mm |
|---|---|---|
| US 2010/0040825A1 | 0 | 4 |
| Prior Art3 | 6 | 8 |
| Invention 1 | 5 | 10 |
| Prior Art4 | 6 | 5 |
| Invention 2 | 14 | 11 |
| Prior Art1 | 6 | 3 |
| Prior Art2 | 1 | 0 |
| Prior Art4 | 1 | 1 |
| Prior Art5 | 1 | 0 |
| Prior Art6 | 0 | 1 |
| Prior Art7 | 0 | 0 |
| Prior Art8 | 0 | 0 |

Figure 32:
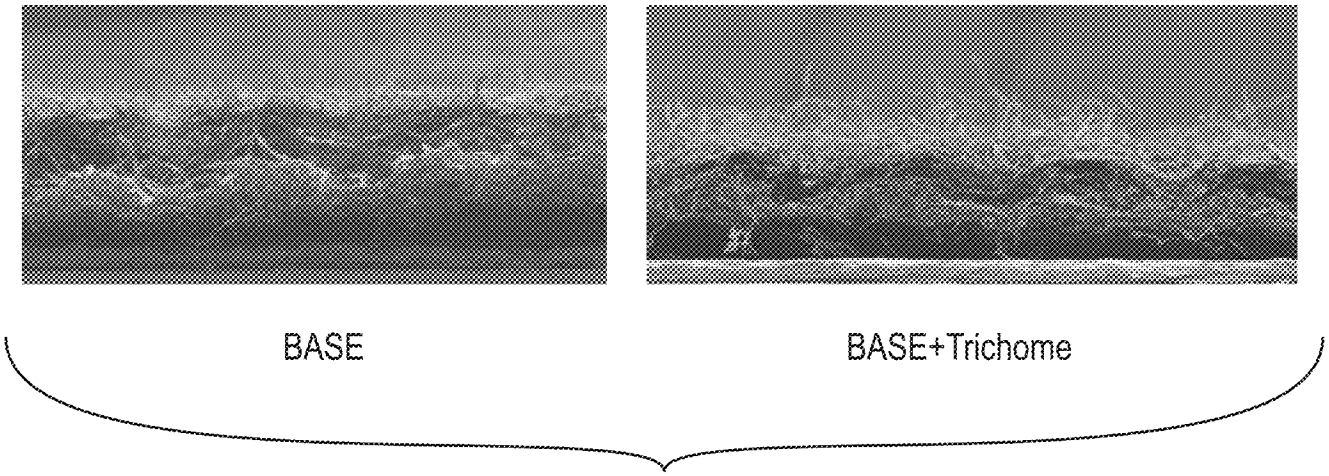
FIG. 32 is two micrographs of examples of portions of fibrous structures as described earlier herein, the first micrograph showing free fiber ends of a fibrous structure that is void of trichomes and the second micrograph showing free fiber ends of a fibrous structure comprising trichomes.

In an example of the present invention, a fibrous structure comprises trichomes, for example trichome fibers. Other naturally-occurring fibers, such as cellulosic wood pulp fibers, and/or non-naturally occurring fibers and/or filaments may be present in the fibrous structures of the present invention. Without being bound by theory, it is believed that the use of trichomes in accordance with the present invention results in higher Free Fiber End Counts compared to known fibrous structures without trichomes. In one example, as shown in FIG. 32, a fibrous structure having 5% by weight on a dry fiber basis of trichome fibers visually exhibits more free fiber ends than a fibrous structure that is otherwise the same except for the lack of trichome fibers.

In one example of the present invention, a fibrous structure comprises a throughdried fibrous structure. The fibrous structure may be creped or uncreped. In one example, the fibrous structure is a wet-laid fibrous structure.

The fibrous structure may be incorporated into a single- or multi-ply sanitary tissue product. The sanitary tissue product may be in roll form where it is convolutedly wrapped about itself with or without the employment of a core.

Figure 15:
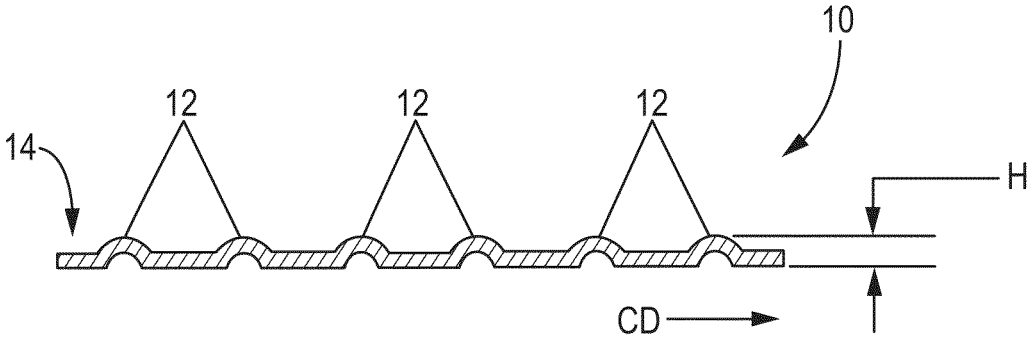
FIG. 15 is a cross-sectional view of FIG. 14 taken along line 15-15.

A non-limiting example of a fibrous structure in accordance with the present invention is shown in FIGS. 14 and 15. FIGS. 14 and 15 show a fibrous structure 10 comprising one or more line elements 12. The line elements 12 are oriented in the machine or substantially the machine direction on the surface 14 of the fibrous structure 10. In one example, one or more of the line elements 12 may exhibit a length L of greater than about 4.5 mm and/or greater than about 6 mm and/or greater than about 10 mm and/or greater than about 20 mm and/or greater than about 30 mm and/or greater than about 45 mm and/or greater than about 60 mm and/or greater than about 75 mm and/or greater than about 90 mm.

In one example, the width W of one or more of the line elements 12 is less than about 10 mm and/or less than about 7 mm and/or less than about 5 mm and/or less than about 2 mm and/or less than about 1.7 mm and/or less than about 1.5 mm, and/or to about 0.10 mm and/or to about 0.20 mm.

In another example, the line element height H of one or more of the line elements 12 is greater than about 0.10 mm and/or greater than about 0.50 mm and/or greater than about 0.75 mm and/or greater than about 1 mm to about 4 mm and/or to about 3 mm and/or to about 2.5 mm and/or to about 2 mm.

In another example, the fibrous structure of the present invention exhibits a ratio of line element height (in mm) to line element width (in mm) of greater than about 0.35 and/or greater than about 0.45 and/or greater than about 0.5 and/or greater than about 0.75 and/or greater than about 1.

One or more of the line elements may exhibit a geometric mean of line element height by line element of width of greater than about 0.25 $mm^2$ and/or greater than about 0.35 $mm^2$ and/or greater than about 0.5 $mm^2$ and/or greater than about 0.75 $mm^2$.

As shown in FIGS. 14 and 15, the fibrous structure 10 may comprise a plurality of substantially machine direction oriented line elements 12 that are present on the fibrous structure 10 at a frequency of greater than about 1 line element/5 cm and/or greater than about 4 line elements/5 cm and/or greater than about 7 line elements/5 cm and/or greater than about 15 line elements/5 cm and/or greater than about 20 line elements/5 cm and/or greater than about 25 line elements/5 cm and/or greater than about 30 line elements/5 cm up to about 50 line elements/5 cm and/or to about 40 line elements/5 cm.

In another example of a fibrous structure according to the present invention, the fibrous structure exhibits a ratio of a frequency of line elements (per cm) to the width (in cm) of one line element of greater than about 3 and/or greater than about 5 and/or greater than about 7.

The line elements of the present invention may be in any shape, such as straight lines, zig-zag lines, serpentine lines. In one example, a line element does not intersect another line element.

Figure 16:
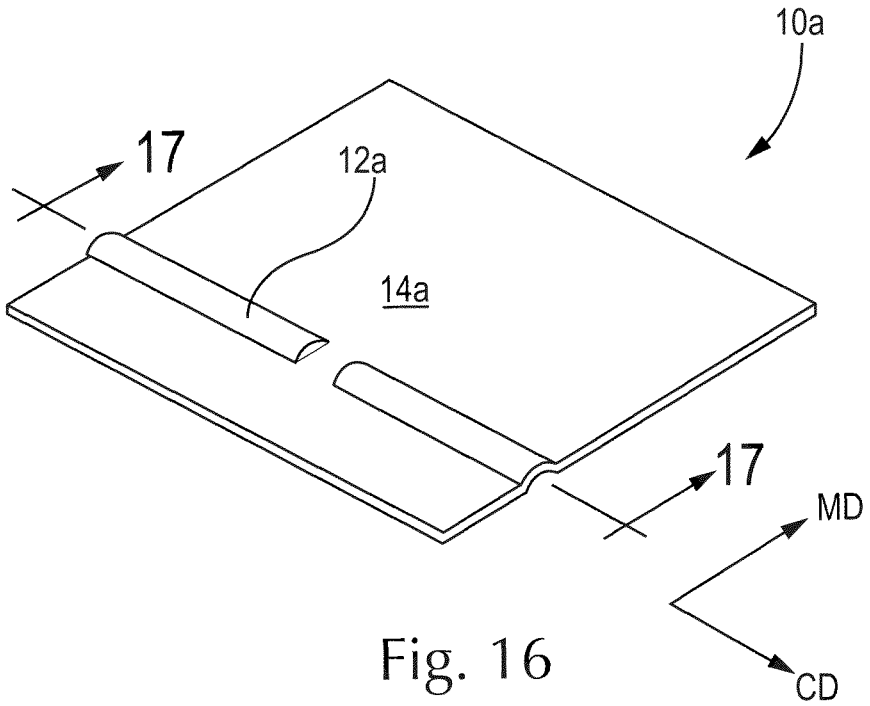
FIG. 16 is a schematic representation of another example of a fibrous structure according to the present invention.
Figure 17:
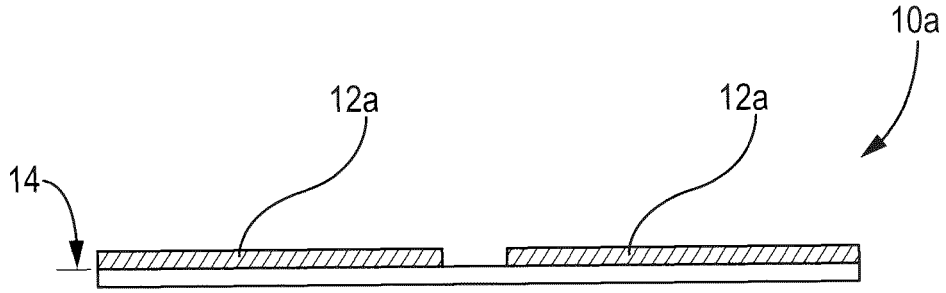
FIG. 17 is a cross-sectional view of FIG. 16 taken along line 17-17.

As shown in FIGS. 16 and 17, a fibrous structure 10*a* of the present invention may comprise one or more line elements 12*a*. The line elements 12*a* may be oriented on a surface 14*a* of a fibrous structure 10*a* in any direction such as machine direction, cross machine direction, substantially machine direction oriented, substantially cross machine direction oriented. Two or more line elements may be oriented in different directions on the same surface of a fibrous structure according to the present invention. In the case of FIGS. 16 and 17, the line elements 12*a* are oriented in the cross machine direction. Even though the fibrous structure 10*a* comprises only two line elements 12*a*, it is within the scope of the present invention for the fibrous structure 10*a* to comprise three or more line elements 12*a*.

The dimensions (length, width and/or height) of the line elements of the present invention may vary from line element to line element within a fibrous structure. As a result, the gap width between neighboring line elements may vary from one gap to another within a fibrous structure.

In another example, a plurality of line elements may be present on a surface of a fibrous structure in a pattern such as in a corduroy pattern.

In still another example, a surface of a fibrous structure may comprise a discontinuous pattern of a plurality of line elements wherein at least one of the line elements exhibits a line element length of greater than about 30 mm.

In yet another example, a surface of a fibrous structure comprises at least one line element that exhibits a width of less than about 10 mm and/or less than about 7 mm and/or less than about 5 mm and/or less than about 3 mm and/or to about 0.01 mm and/or to about 0.1 mm and/or to about 0.5 mm.

The line elements may exhibit any suitable height known to those of skill in the art. For example, a line element may exhibit a height of greater than about 0.10 mm and/or greater than about 0.20 mm and/or greater than about 0.30 mm to about 3.60 mm and/or to about 2.75 mm and/or to about 1.50 mm. A line element's height is measured irrespective of arrangement of a fibrous structure in a multi-ply fibrous structure, for example, the line element's height may extend inward within the fibrous structure.

The fibrous structures of the present invention may comprise at least one line element that exhibits a height to width ratio of greater than about 0.350 and/or greater than about 0.450 and/or greater than about 0.500 and/or greater than about 0.600 and/or to about 3 and/or to about 2 and/or to about 1.

In another example, a line element on a surface of a fibrous structure may exhibit a geometric mean of height by width of greater than about 0.250 and/or greater than about 0.350 and/or greater than about 0.450 and/or to about 3 and/or to about 2 and/or to about 1.

The fibrous structures of the present invention may comprise line elements in any suitable frequency. For example, a surface of a fibrous structure may comprise line elements at a frequency of greater than about 1 line element/5 cm and/or greater than about 1 line element/3 cm and/or greater than about 1 line element/cm and/or greater than about 3 line elements/cm.

In one example, a fibrous structure comprises a plurality of line elements that are present on a surface of the fibrous structure at a ratio of frequency of line elements to width of at least one line element of greater than about 3 and/or greater than about 5 and/or greater than about 7.

The fibrous structure of the present invention may comprise a surface comprising a plurality of line elements such that the ratio of geometric mean of height by width of at least one line element to frequency of line elements is greater than about 0.050 and/or greater than about 0.750 and/or greater than about 0.900 and/or greater than about 1 and/or greater than about 2 and/or up to about 20 and/or up to about 15 and/or up to about 10.

Figure 18:
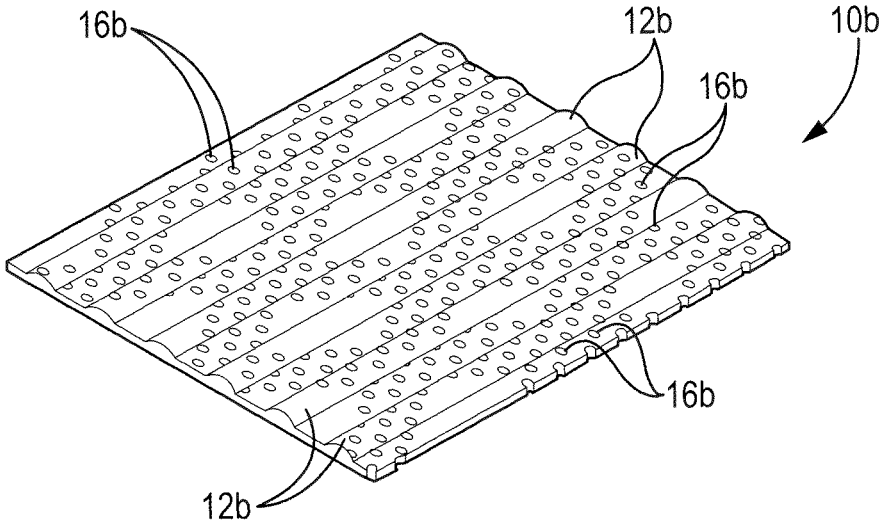
FIG. 18 is a schematic representation of another example of a fibrous structure according to the present invention.

In addition to one or more line elements 12*b*, as shown in FIG. 18, a fibrous structure 10*b* of the present invention may further comprise one or more non-line elements 16*b*. In one example, a non-line element 16*b* present on the surface 14*b* of a fibrous structure 10*b* is water-resistant. In another example, a non-line element 16*b* present on the surface 14*b* of a fibrous structure 10*b* comprises an embossment. When present on a surface of a fibrous structure, a plurality of non-line elements may be present in a pattern. The pattern may comprise a geometric shape such as a polygon. Non-limiting example of suitable polygons are selected from the group consisting of: triangles, diamonds, trapezoids, parallelograms, rhombuses, stars, pentagons, hexagons, octagons and mixtures thereof.

Figure 19:
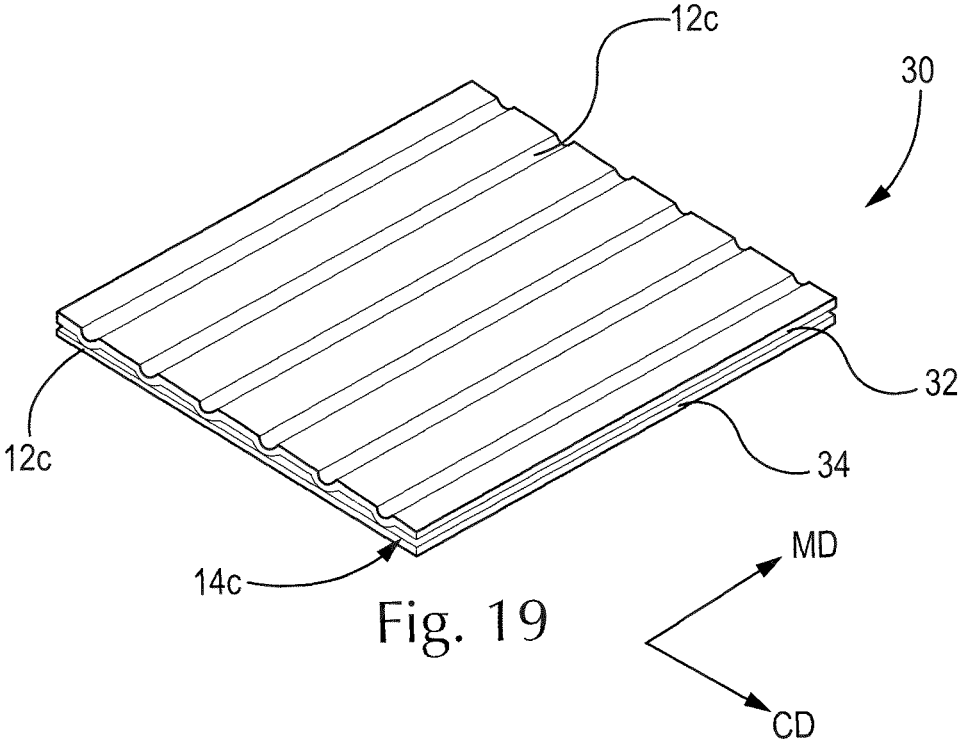
FIG. 19 is a schematic representation of another example of a fibrous structure according to the present invention.

One or more of the fibrous structures of the present invention may form a single- or multi-ply sanitary tissue product. In one example, as shown in FIG. 19, a multi-ply sanitary tissue product 30 comprises a first ply 32 and a second ply 34 wherein the first ply 32 comprises a surface 14*c* comprising a plurality of line elements 12*c*, in this case being oriented in the machine direction or substantially machine direction oriented. The plies 32 and 34 are arranged such that the line elements 12*c* extend inward into the interior of the sanitary tissue product 30 rather than outward.

Figure 20:
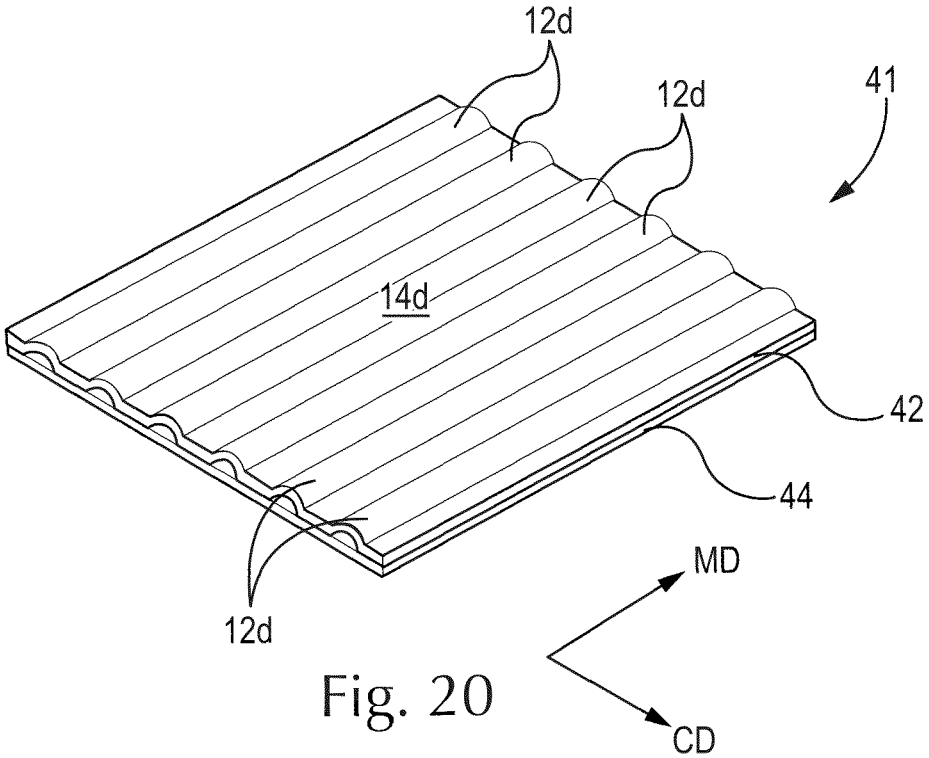
FIG. 20 is a schematic representation of another example of a fibrous structure according to the present invention.

In another example, as shown in FIG. 20, a multi-ply sanitary tissue product 41 comprises a first ply 42 and a second ply 44 wherein the first ply 42 comprises a surface 14*d* comprising a plurality of line elements 12*d*, in this case being oriented in the machine direction or substantially machine direction oriented. The plies 42 and 44 are arranged such that the line elements 12*d* extend outward from the surface 14*d* of the sanitary tissue product 40 rather than inward into the interior of the sanitary tissue product 41.

Figure 21:
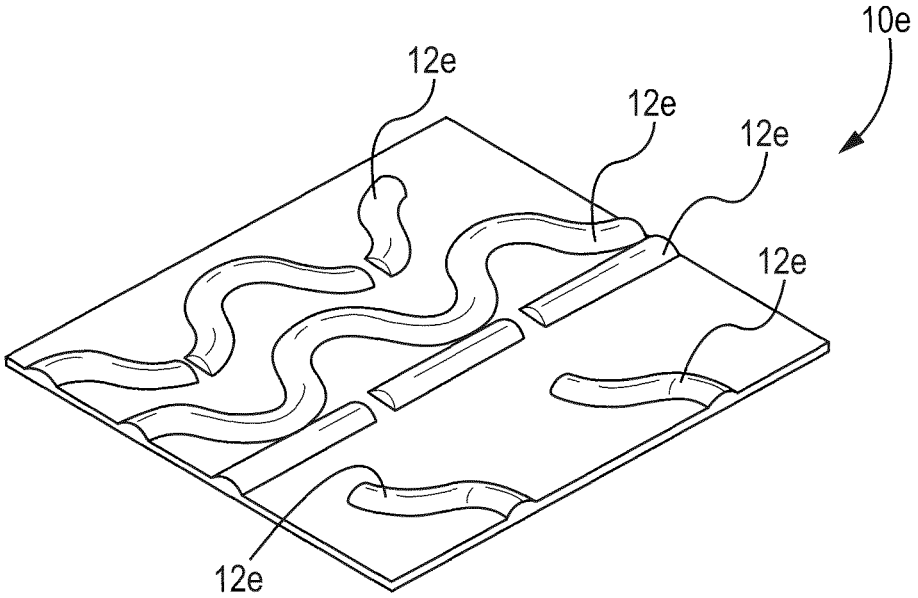
FIG. 21 is a schematic representation of an example of a fibrous structure according to the present invention comprising various forms of line elements in accordance with the present invention.

As shown in FIG. 21, a fibrous structure 10*e* of the present invention may comprise a variety of different forms of line elements 12*e*, alone or in combination, such as serpentines, dashes, MD and/or CD oriented line elements, and the like.

Figure 22:
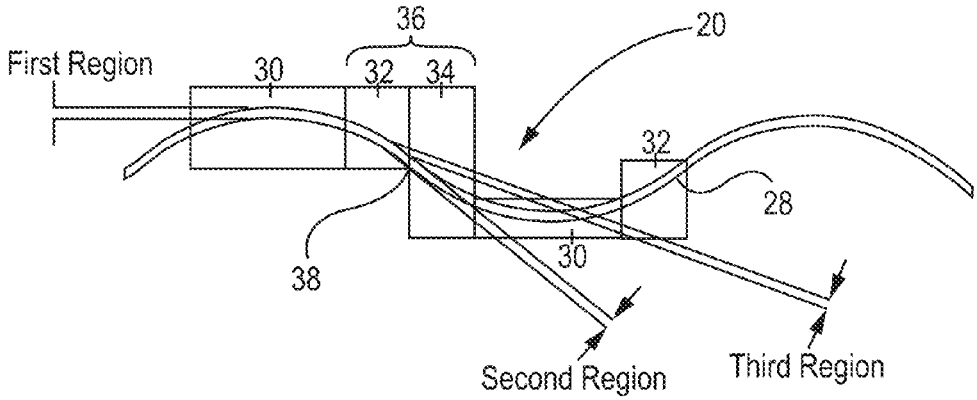
FIG. 22 is a schematic representation of an example of a line element according to the present invention.
Figure 23:
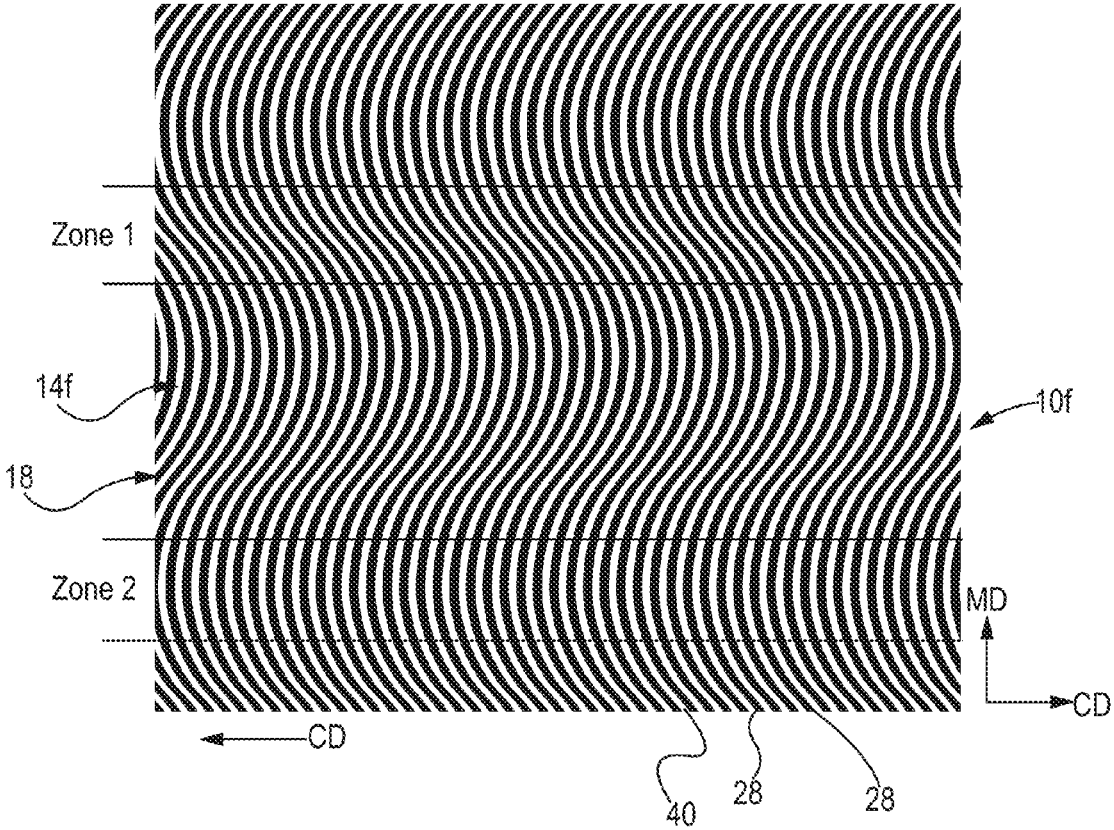
FIG. 23 is a top plan view of another example of a surface pattern of a fibrous structure according to the present invention.

As shown in FIGS. 22 and 23, a fibrous structure 10*f* of the present invention comprises a surface 14*f* and a surface pattern 18. Zone 1 of FIG. 23 comprises the second and third regions 32, 34 of a sinusoidal line element 28 shown in FIG. 22, which also happens to be the transition region 36, and exhibits the second minimum width $W_2$ and the third minimum width $W_3$, which may be the same. Zone 2 comprises the first region 30 of a sinusoidal line element 28, which also happens to be either a crest or a trough of the sinusoidal line element 28, and exhibits the first minimum width $W_1$. The first minimum width $W_1$ is greater than the second minimum width $W_2$ and the third minimum width $W_3$.

In one example, Zone 1 exhibits an elevation that is different from Zone 2. In one example, Zone 2 exhibits a greater elevation than Zone 1 as measured according to MikroCAD. In another example, Zone 2 exhibits a lesser elevation than Zone 1 as measured according to MikroCAD. In one fibrous structure, there may be two or more Zone 1s and two or more Zone 2s. The Zone 1s across at least a portion of the fibrous structure 10*f* may exhibit a substantially similar elevation whereas the Zone 2s may exhibit greater and lesser elevations compared to the Zone 1 elevations.

In addition to the elevation differences between Zone 1s and Zone 2s, the fibrous structures of the present invention may comprise zones, such as Zone 1 and Zone 2 that exhibit differences in their respective CD stress (tensile strength)/strain (elongation) slopes. For example, the difference between the greater of the Zone 1 and Zone 2 CD stress/strain slopes and the lesser of the Zone 1 and Zone 2 CD stress/strain slopes is greater than 1.1 and/or greater than 1.5 and/or greater than 2 and/or greater than 2.5 and/or greater than 3 and/or greater than 3.5 and/or greater than 4 and/or greater than 4.5 as measured according to the Tensile Test Method described herein.

In another example, the fibrous structures of the present invention may comprise different zones, such as Zone 1 and Zone 2 that exhibit differences in their respective CD stress (tensile strength)/strain (elongation) slopes that result in a ratio of the greater of the Zone 1 and Zone 2 CD stress/strain slopes and the lesser of the Zone 1 and Zone 2 CD stress/strain slopes of greater than 1.07 and/or greater than 1.09 and/or greater than 1 and/or greater than 1.2 and/or greater than 1.4 and/or greater than 4 and/or greater than 4.5 as measured according to the Tensile Test Method described herein.

In still another example of the present invention, the fibrous structures of the present invention may comprise different zones, such as Zone 1 and Zone 2 that exhibit differences in their respective CD Modulii. For example, the difference between the greater of the Zone 1 and Zone 2 CD Modulii and the lesser of the Zone 1 and Zone 2 CD Modulii is greater than 150 g/cm*% at 15 g/cm and/or greater than 200 g/cm*% at 15 g/cm and/or greater than 250 g/cm*% at 15 g/cm and/or greater than 300 g/cm*% at 15 g/cm and/or greater than 350 g/cm*% at 15 g/cm and/or greater than 400 g/cm*% at 15 g/cm and/or greater than 420 g/cm*% at 15 g/cm as measured according to the Tensile Test Method described herein.

In yet another example of the present invention, the fibrous structures of the present invention may comprise different zones, such as Zone 1 and Zone 2 that exhibit differences in their respective CD Modulii that result in a ratio of the greater of the Zone 1 and Zone 2 CD Modulii and the lesser of the Zone 1 and Zone 2 CD Modulii of greater than 1.15 and/or greater than 1.17 and/or greater than 1.20 and/or greater than 1.25 and/or greater than 1.30 and/or greater than 1.35 as measured according to the Tensile Test Method described herein.

Although the discussion regarding FIGS. 22 and 23 has been focused on the parallel line elements 20, such as the sinusoidal line elements 28, in one example as shown, there are channels 40 that separate the parallel line elements 20. The channels 40 and the parallel line elements 20, such as the sinusoidal line elements 28 may be reversed so that the channels 40 in FIG. 23 would represent the parallel line elements 20 and the parallel line elements 20 would represent the channels 40.

Figure 24:
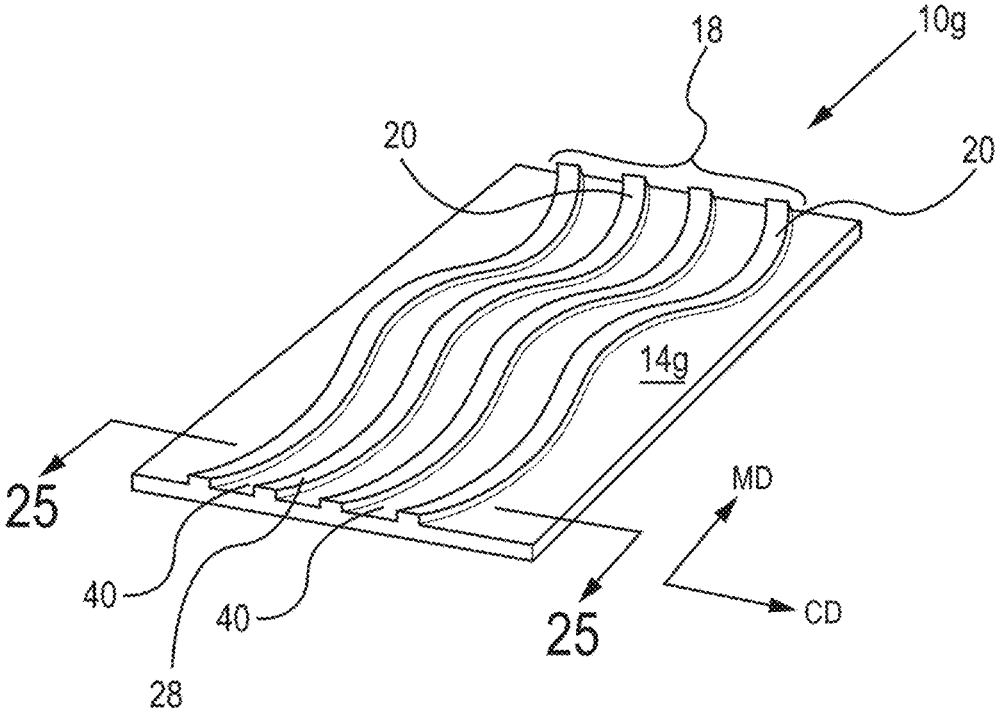
FIG. 24 is a perspective view of an example of a fibrous structure comprising a schematic representation of the surface pattern of FIG. 23.
Figure 25:
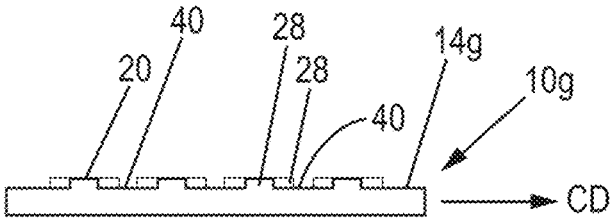
FIG. 25 is a cross-sectional view of FIG. 24 taken along line 25-25.

FIGS. 24 and 25 illustrate another example of a fibrous structure 10*g* according to the present invention. The fibrous structure 10*g* comprises a surface 14*g* exhibiting a machine direction and a cross machine direction. The surface 14*g* comprises a surface pattern 18 comprising a plurality of parallel line elements 20, which in this example comprise a plurality of parallel sinusoidal line elements 28. At least one of the plurality of parallel sinusoidal line elements 28 exhibits a non-constant width along its length.

In one example, one or more portions (sections) of a line element may exhibit a constant width so long as the line element as a whole exhibits a non-constant width.

In another example, one or more line elements and/or channels and/or portions (sections or regions) thereof of the present invention, which may complement one another as a result of the line elements being a plurality of parallel line elements, may exhibit minimum widths of greater than 0.01 inch and/or greater than 0.015 inch and/or greater than 0.02 inch and/or greater than 0.025 inch and/or greater than 0.03 inch and/or greater than 0.035 inch and/or greater than 0.04 inch and/or greater than 0.045 inch and/or greater than 0.05 inch and/or greater than 0.075 inch and/or to about 1 inch and/or to about 0.7 inch and/or to about 0.5 inch and/or to about 0.25 inch and/or to about 0.1 inch. Two or more of the parallel line elements may be separated from one another by a minimum width of greater than 0.01 inch and/or greater than 0.015 inch and/or greater than 0.02 inch and/or greater than 0.025 inch and/or greater than 0.03 inch and/or greater than 0.035 inch and/or greater than 0.04 inch and/or greater than 0.045 inch and/or greater than 0.05 inch and/or greater than 0.075 inch and/or to about 1 inch and/or to about 0.7 inch and/or to about 0.5 inch and/or to about 0.25 inch and/or to about 0.1 inch.

The surface pattern may be an emboss pattern, imparted by passing a fibrous structure through an embossing nip comprising at least one patterned embossing roll patterned to impart a surface pattern according to the present invention. Likewise, the surface pattern may be imparted as a water-resistant pattern (i.e., wet textured pattern), such as a pattern formed by a patterned through-air-drying belt that is structured to impart a surface pattern according to the present invention, and/or a rush transfer or fabric creped or wet pressed imparted surface pattern or portions thereof, which imparts texture to the sanitary tissue product typically during the sanitary tissue product-making process.

Without being bound by theory, it is believed that line elements increase the potential for free fiber ends. In one nonlimiting example, line elements on a fibrous structure may come in contact with a creping blade, which may cause the line elements to expand and areas surrounding the line elements to buckle. The stress on the fibrous structure may cause the fibers therein, particularly the fibers along the sides of the line elements, to break, resulting in an increased number of free fiber ends.

Methods for Making Fibrous Structures/Sanitary Tissue Products

The fibrous structures and/or sanitary tissue products of the present invention may be made by any suitable process known in the art. The method may be a fibrous structure and/or sanitary tissue product making process that uses a cylindrical dryer such as a Yankee (a Yankee-process) or it may be a Yankeeless process as is used to make substantially uniform density and/or uncreped fibrous structures and/or sanitary tissue products. Alternatively, the fibrous structures and/or sanitary tissue products may be made by an air-laid process and/or meltblown and/or spunbond processes and any combinations thereof so long as the fibrous structures and/or sanitary tissue products of the present invention are made thereby.

The fibrous structure and/or sanitary tissue product of the present invention may be made using a molding member. A "molding member" is a structural element that can be used as a support for an embryonic web comprising a plurality of cellulosic fibers and a plurality of synthetic fibers, as well as a forming unit to form, or "mold," a desired microscopical geometry of the fibrous structure and/or sanitary tissue product of the present invention. The molding member may comprise any element that has fluid-permeable areas and the ability to impart a microscopical three-dimensional pattern to the fibrous structure being produced thereon, and includes, without limitation, single-layer and multi-layer structures comprising a stationary plate, a belt, a woven fabric (including Jacquard-type and the like woven patterns), a band, and a roll. In one example, the molding member is a deflection member. The molding member may comprise a surface pattern according to the present invention that is imparted to the fibrous structure and/or sanitary tissue product during the fibrous structure and/or sanitary tissue product making process. The molding member may be a patterned belt that comprises a surface pattern.

A "reinforcing element" is a desirable (but not necessary) element in some embodiments of the molding member, serving primarily to provide or facilitate integrity, stability, and durability of the molding member comprising, for example, a resinous material. The reinforcing element can be fluid-permeable or partially fluid-permeable, may have a variety of embodiments and weave patterns, and may comprise a variety of materials, such as, for example, a plurality of interwoven yarns (including Jacquard-type and the like woven patterns), a felt, a plastic, other suitable synthetic material, or any combination thereof.

In one example of a method for making a fibrous structure and/or sanitary tissue product of the present invention, the method comprises the step of contacting an embryonic fibrous web with a molding member, for example a deflection member, such that at least one portion of the embryonic fibrous web is deflected out-of-plane of another portion of the embryonic fibrous web. The phrase "out-of-plane" as used herein means that the fibrous structure and/or sanitary tissue product comprises a protuberance, such as a dome, line element, or a cavity, such as a channel, that extends away from the plane of the fibrous structure and/or sanitary tissue product. The molding member may comprise a through-air-drying fabric having its filaments arranged to produce line elements within the fibrous structures and/or sanitary tissue products of the present invention and/or the through-air-drying fabric or equivalent may comprise a resinous framework that defines deflection conduits that allow portions of the fibrous structure and/or sanitary tissue product to deflect into the conduits thus forming line elements within the fibrous structures and/or sanitary tissue products of the present invention. In addition, a forming wire, such as a foraminous member may be arranged such that line elements within the fibrous structures and/or sanitary tissue products of the present invention are formed and/or like the through-air-drying fabric, the foraminous member may comprise a resinous framework that defines deflection conduits that allow portions of the sanitary tissue product to deflect into the conduits thus forming line elements within the fibrous structures and/or sanitary tissue products of the present invention.

In another example of a method for making a fibrous structure and/or sanitary tissue product of the present invention, the method comprises the steps of:

(a) providing a fibrous furnish comprising fibers;
(b) depositing the fibrous furnish onto a foraminous member to form an embryonic fibrous web;
(c) associating the embryonic fibrous web with a molding member comprising a surface pattern having a line element such that the surface pattern having a line element is imparted to the web; and
(d) drying said embryonic fibrous web such that the surface pattern having a line element is imparted to the dried fibrous structure and/or sanitary tissue product to produce the fibrous structure and/or sanitary tissue product according to the present invention.

In another example, the method may comprise a step of imparting a surface pattern to a fibrous structure and/or sanitary tissue product using an embossing nip. The step may comprise passing the fibrous structure and/or sanitary tissue product through an embossing nip formed by at least one embossing roll comprising a surface pattern such that the surface pattern is imparted to the fibrous structure and/or sanitary tissue product to make a fibrous structure and/or sanitary tissue product according to the present invention.

In still another example of the present invention, a method for making a fibrous structure according to the present invention comprises the steps of:

a. forming an embryonic fibrous structure (i.e., base web);
b. molding the embryonic fibrous structure using a molding member (i.e., papermaking belt) such that a fibrous structure having a line element according to the present invention is formed; and
c. drying the fibrous structure;
d. optionally, foreshortening the fibrous structure (such as by creping the fibrous structure).

Figure 26:
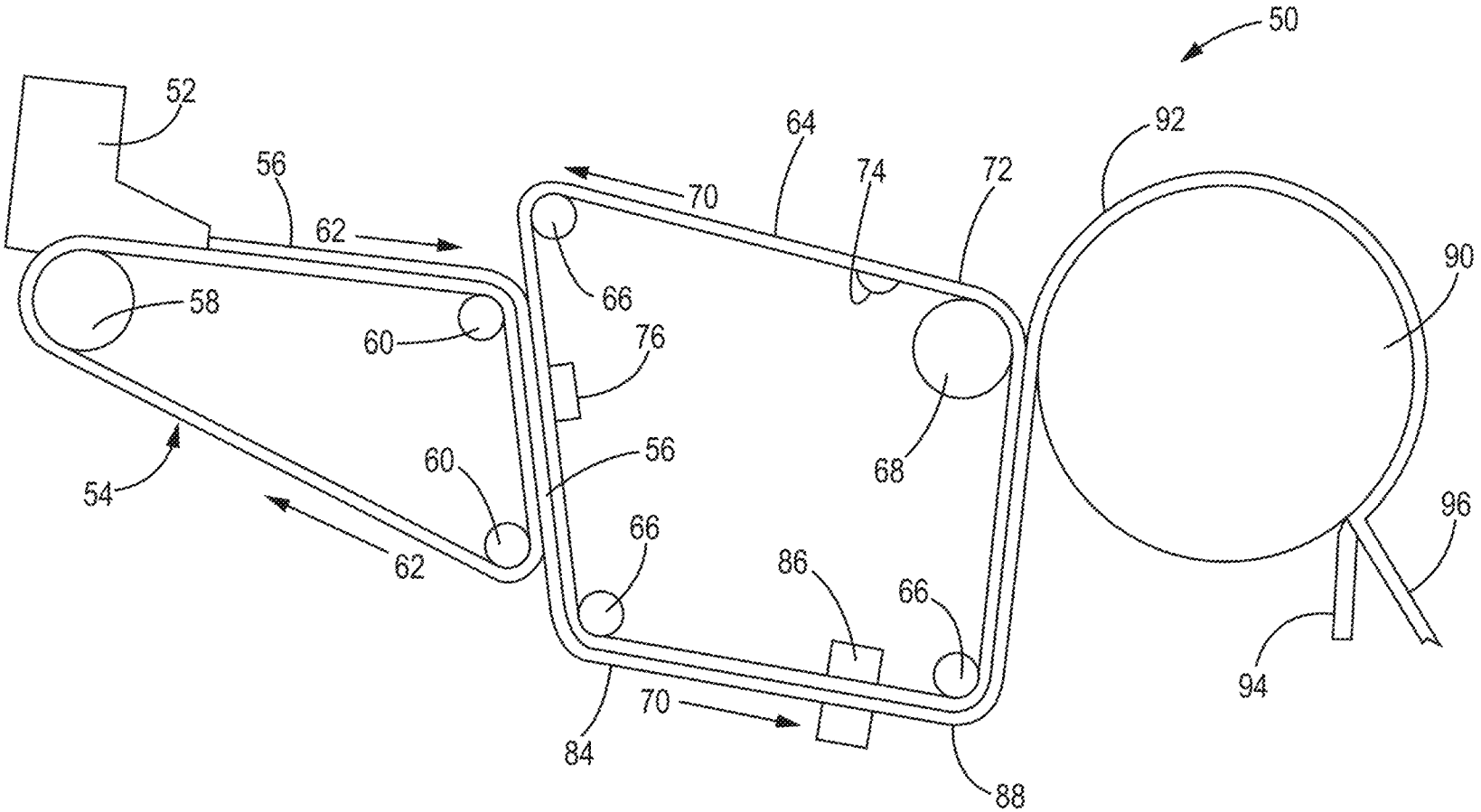
FIG. 26 is a schematic representation of an example of a method for making a fibrous structure according to the present invention.

FIG. 26 is a simplified, schematic representation of one example of a continuous fibrous structure making process and machine useful in the practice of the present invention.

As shown in FIG. 26, one example of a process and equipment, represented as 50 for making a fibrous structure according to the present invention comprises supplying an aqueous dispersion of fibers (a fibrous furnish) to a headbox 52 which can be of any convenient design. From the headbox 52, the aqueous dispersion of fibers is delivered to a first foraminous member 54, which is typically a Fourdrinier wire, to produce an embryonic fibrous web 56.

The first foraminous member 54 may be supported by a breast roll 58 and a plurality of return rolls 60 of which only two are shown. The first foraminous member 54 can be propelled in the direction indicated by directional arrow 62 by a drive means, not shown. Optional auxiliary units and/or devices commonly associated fibrous structure making machines and with the first foraminous member 54, but not shown, include forming boards, hydrofoils, vacuum boxes, tension rolls, support rolls, wire cleaning showers, and the like.

After the aqueous dispersion of fibers is deposited onto the first foraminous member 54, embryonic fibrous web 56 is formed, typically by the removal of a portion of the aqueous dispersing medium by techniques well known to those skilled in the art. Vacuum boxes, forming boards, hydrofoils, and the like are useful in effecting water removal. The embryonic fibrous web 56 may travel with the first foraminous member 54 about return roll 60 and is brought into contact with a molding member, such as a deflection member 64, which may also be referred to as a second foraminous member. While in contact with the deflection member 64, the embryonic fibrous web 56 will be deflected, rearranged, and/or further dewatered.

The deflection member 64 may be in the form of an endless belt. In this simplified representation, deflection member 64 passes around and about deflection member return rolls 66 and impression nip roll 68 and may travel in the direction indicated by directional arrow 70. Associated with deflection member 64, but not shown, may be various support rolls, other return rolls, cleaning means, drive means, and the like well known to those skilled in the art that may be commonly used in fibrous structure making machines.

Regardless of the physical form which the deflection member 64 takes, whether it is an endless belt as just discussed or some other embodiment such as a stationary plate for use in making handsheets or a rotating drum for use with other types of continuous processes, it must have certain physical characteristics. For example, the deflection member may take a variety of configurations such as belts, drums, flat plates, and the like.

First, the deflection member 64 may be foraminous. That is to say, it may possess continuous passages connecting its first surface 72 (or "upper surface" or "working surface"; i.e. the surface with which the embryonic fibrous web is associated, sometimes referred to as the "embryonic fibrous web-contacting surface") with its second surface 74 (or "lower surface"; i.e., the surface with which the deflection member return rolls are associated). In other words, the deflection member 64 may be constructed in such a manner that when water is caused to be removed from the embryonic fibrous web 56, as by the application of differential fluid pressure, such as by a vacuum box 76, and when the water is removed from the embryonic fibrous web 56 in the direction of the deflection member 64, the water can be discharged from the system without having to again contact the embryonic fibrous web 56 in either the liquid or the vapor state.

Figure 27:
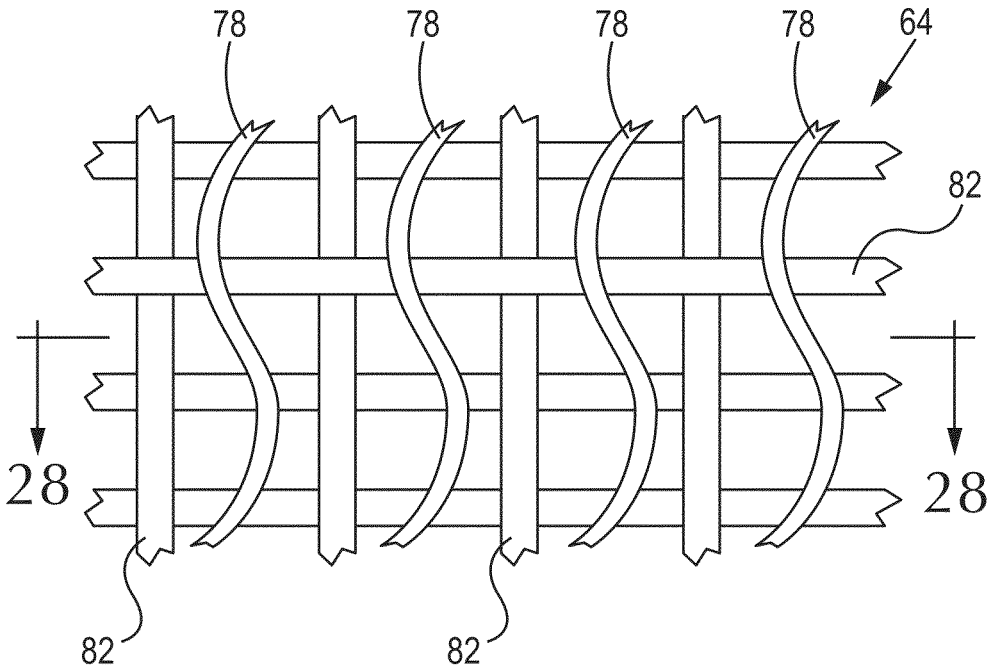
FIG. 27 is a schematic representation of a portion of an example of a molding member suitable for use in the methods of the present invention.
Figure 28:
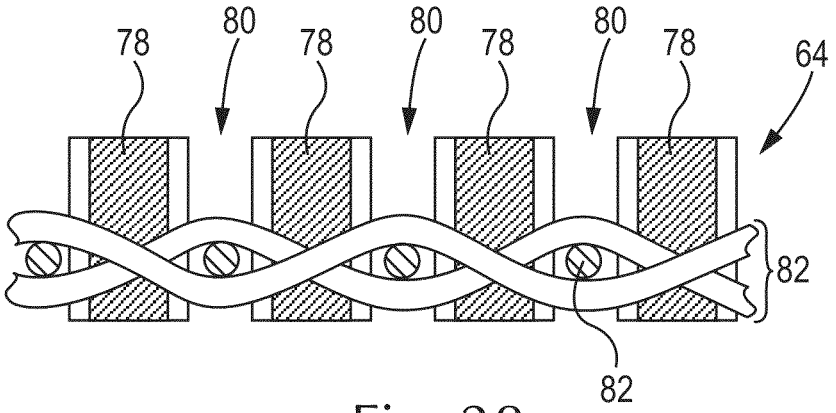
FIG. 28 is a cross-sectional view of FIG. 27 taken along line 28-28.
Figure 29:
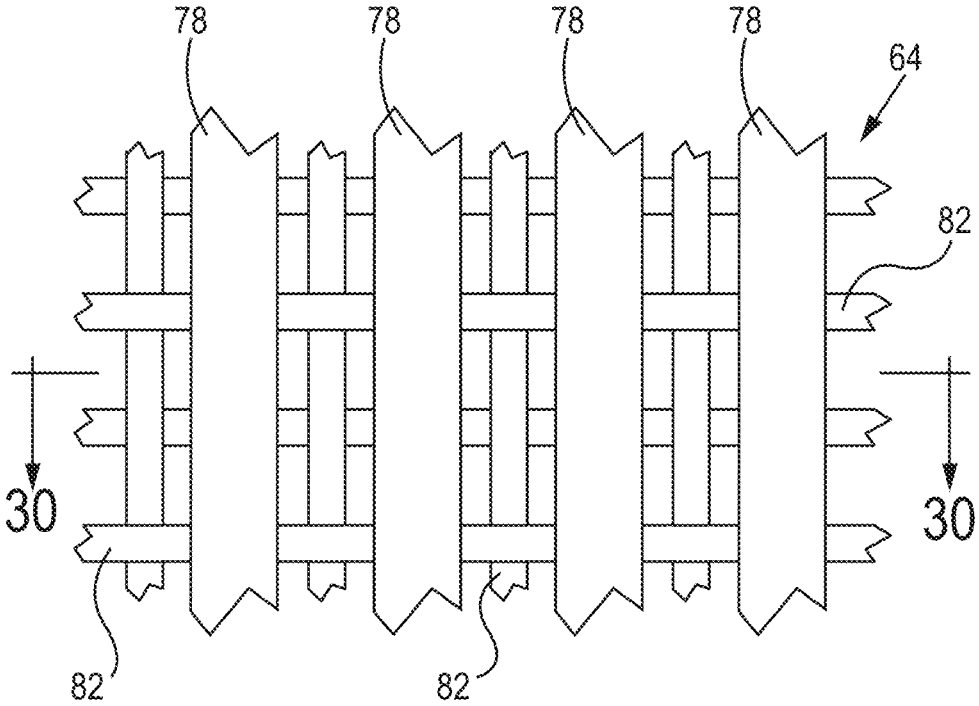
FIG. 29 is a schematic representation a portion of another example of a molding member suitable for use in the methods of the present invention.
Figure 30:
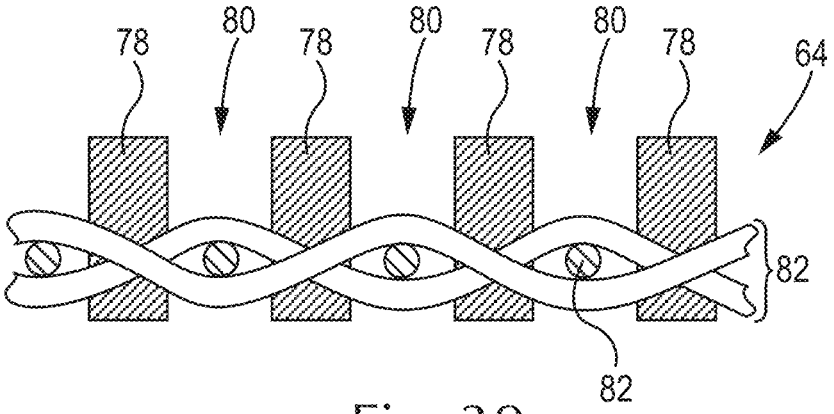
FIG. 30 is a cross-sectional view of FIG. 29 taken along line 30-30.

Second, the first surface 72 of the deflection member 64 may comprise one or more ridges 78 as represented in one example in FIGS. 27 and 28 or in another example in FIGS. 29 and 30. The ridges 78 may be made by any suitable material. For example, a resin may be used to create the ridges 78. The ridges 78 may be continuous, or essentially continuous. In one example, the ridges 78 exhibit a length of greater than about 30 mm. The ridges 78 may be arranged to produce the fibrous structures of the present invention when utilized in a suitable fibrous structure making process. The ridges 78 may be patterned. The ridges 78 may be present on the deflection member 64 at any suitable frequency to produce the fibrous structures of the present invention. The ridges 78 may define within the deflection member 64 a plurality of deflection conduits 80. The deflection conduits 80 may be discrete, isolated, deflection conduits.

The deflection conduits 80 of the deflection member 64 may be of any size and shape or configuration so long as the deflection conduits 80 produce a plurality of line elements in the fibrous structure produced thereby. The deflection conduits 80 may repeat in a random pattern or in a uniform pattern. Portions of the deflection member 64 may comprise deflection conduits 80 that repeat in a random pattern and other portions of the deflection member 64 may comprise deflection conduits 80 that repeat in a uniform pattern.

The ridges 78 of the deflection member 64 may be associated with a belt, wire or other type of substrate. As shown in FIGS. 27 and 28 or FIGS. 29 and 30, the ridges 78 of the deflection member 64 is associated with a woven belt 82. The woven belt 82 may be made by any suitable material, for example polyester, known to those skilled in the art.

As shown in FIG. 28 or FIG. 30, a cross sectional view of a portion of the deflection member 64 taken along line 28-28 of FIG. 27 or taken along line 30-30 of FIG. 29, respectively, the deflection member 64 can be foraminous since the deflection conduits 80 extend completely through the deflection member 64.

In one example, the deflection member of the present invention may be an endless belt which can be constructed by, among other methods, a method adapted from techniques used to make stencil screens. By "adapted" it is meant that the broad, overall techniques of making stencil screens are used, but improvements, refinements, and modifications as discussed below are used to make member having significantly greater thickness than the usual stencil screen.

Broadly, a foraminous member (such as a woven belt) is thoroughly coated with a liquid photosensitive polymeric resin to a preselected thickness. A mask or negative incorporating the pattern of the preselected ridges is juxtaposed the liquid photosensitive resin; the resin is then exposed to light of an appropriate wave length through the mask. This exposure to light causes curing of the resin in the exposed areas. Unexpected (and uncured) resin is removed from the system leaving behind the cured resin forming the ridges defining within it a plurality of deflection conduits.

In another example, the deflection member can be prepared using as the foraminous member, such as a woven belt, of width and length suitable for use on the chosen fibrous structure making machine. The ridges and the deflection conduits are formed on this woven belt in a series of sections of convenient dimensions in a batchwise manner, i.e. one section at a time. Details of this non-limiting example of a process for preparing the deflection member follow.

First, a planar forming table is supplied. This forming table is at least as wide as the width of the foraminous woven element and is of any convenient length. It is provided with means for securing a backing film smoothly and tightly to its surface. Suitable means include provision for the application of vacuum through the surface of the forming table, such as a plurality of closely spaced orifices and tensioning means.

A relatively thin, flexible polymeric (such as polypropylene) backing film is placed on the forming table and is secured thereto, as by the application of vacuum or the use of tension. The backing film serves to protect the surface of the forming table and to provide a smooth surface from which the cured photosensitive resins will, later, be readily released. This backing film will form no part of the completed deflection member.

Either the backing film is of a color which absorbs activating light or the backing film is at least semi-transparent and the surface of the forming table absorbs activating light.

A thin film of adhesive, such as 8091 Crown Spray Heavy Duty Adhesive made by Crown Industrial Products Co. of Hebron, Ill., is applied to the exposed surface of the backing film or, alternatively, to the knuckles of the woven belt. A section of the woven belt is then placed in contact with the backing film where it is held in place by the adhesive. The woven belt is under tension at the time it is adhered to the backing film.

Next, the woven belt is coated with liquid photosensitive resin. As used herein, "coated" means that the liquid photosensitive resin is applied to the woven belt where it is carefully worked and manipulated to insure that all the openings (interstices) in the woven belt are filled with resin and that all of the filaments comprising the woven belt are enclosed with the resin as completely as possible. Since the knuckles of the woven belt are in contact with the backing film, it will not be possible to completely encase the whole of each filament with photosensitive resin. Sufficient additional liquid photosensitive resin is applied to the woven belt to form a deflection member having a certain preselected thickness. The deflection member can be from about 0.35 mm (0.014 in.) to about 3.0 mm (0.150 in.) in overall thickness and the ridges can be spaced from about 0.10 mm (0.004 in.) to about 2.54 mm (0.100 in.) from the mean upper surface of the knuckles of the woven belt. Any technique well known to those skilled in the art can be used to control the thickness of the liquid photosensitive resin coating. For example, shims of the appropriate thickness can be provided on either side of the section of deflection member under construction; an excess quantity of liquid photosensitive resin can be applied to the woven belt between the shims; a straight edge resting on the shims and can then be drawn across the surface of the liquid photosensitive resin thereby removing excess material and forming a coating of a uniform thickness.

Suitable photosensitive resins can be readily selected from the many available commercially. They are typically materials, usually polymers, which cure or cross-link under the influence of activating radiation, usually ultraviolet (UV) light. References containing more information about liquid photosensitive resins include Green et al, "Photocross-linkable Resin Systems," J. Macro. Sci-Revs. Macro. Chem, C21 (2), 187-273 (1981-82); Boyer, "A Review of Ultraviolet Curing Technology," Tappi Paper Synthetics Conf. Proc., Sep. 25-27, 1978, pp 167-172; and Schmidle, "Ultraviolet Curable Flexible Coatings," J. of Coated Fabrics, 8, 10-20 (July, 1978). All the preceding three references are incorporated herein by reference. In one example, the ridges are made from the Merigraph series of resins made by Hercules Incorporated of Wilmington, Del.

Once the proper quantity (and thickness) of liquid photosensitive resin is coated on the woven belt, a cover film is optionally applied to the exposed surface of the resin. The cover film, which must be transparent to light of activating wave length, serves primarily to protect the mask from direct contact with the resin.

A mask (or negative) is placed directly on the optional cover film or on the surface of the resin. This mask is formed of any suitable material which can be used to shield or shade certain portions of the liquid photosensitive resin from light while allowing the light to reach other portions of the resin. The design or geometry preselected for the ridges is, of course, reproduced in this mask in regions which allow the transmission of light while the geometries preselected for the gross foramina are in regions which are opaque to light.

A rigid member such as a glass cover plate is placed atop the mask and serves to aid in maintaining the upper surface of the photosensitive liquid resin in a planar configuration.

The liquid photosensitive resin is then exposed to light of the appropriate wave length through the cover glass, the mask, and the cover film in such a manner as to initiate the curing of the liquid photosensitive resin in the exposed areas. It is important to note that when the described procedure is followed, resin which would normally be in a shadow cast by a filament, which is usually opaque to activating light, is cured. Curing this particular small mass of resin aids in making the bottom side of the deflection member planar and in isolating one deflection conduit from another.

After exposure, the cover plate, the mask, and the cover film are removed from the system. The resin is sufficiently cured in the exposed areas to allow the woven belt along with the resin to be stripped from the backing film.

Uncured resin is removed from the woven belt by any convenient means such as vacuum removal and aqueous washing.

A section of the deflection member is now essentially in final form. Depending upon the nature of the photosensitive resin and the nature and amount of the radiation previously supplied to it, the remaining, at least partially cured, photosensitive resin can be subjected to further radiation in a post curing operation as required.

The backing film is stripped from the forming table and the process is repeated with another section of the woven belt. Conveniently, the woven belt is divided off into sections of essentially equal and convenient lengths which are numbered serially along its length. Odd numbered sections are sequentially processed to form sections of the deflection member and then even numbered sections are sequentially processed until the entire belt possesses the characteristics required of the deflection member. The woven belt may be maintained under tension at all times.

In the method of construction just described, the knuckles of the woven belt actually form a portion of the bottom surface of the deflection member. The woven belt can be physically spaced from the bottom surface.

Multiple replications of the above described technique can be used to construct deflection members having the more complex geometries.

The deflection member of the present invention may be made or partially made according to U.S. Pat. No. 4,637,859, issued Jan. 20, 1987 to Trokhan.

As shown in FIG. 26, after the embryonic fibrous web 56 has been associated with the deflection member 64, fibers within the embryonic fibrous web 56 are deflected into the deflection conduits present in the deflection member 64. In one example of this process step, there is essentially no water removal from the embryonic fibrous web 56 through the deflection conduits after the embryonic fibrous web 56 has been associated with the deflection member 64 but prior to the deflecting of the fibers into the deflection conduits. Further water removal from the embryonic fibrous web 56 can occur during and/or after the time the fibers are being deflected into the deflection conduits. Water removal from the embryonic fibrous web 56 may continue until the consistency of the embryonic fibrous web 56 associated with deflection member 64 is increased to from about 25% to about 35%. Once this consistency of the embryonic fibrous web 56 is achieved, then the embryonic fibrous web 56 is referred to as an intermediate fibrous web 84. During the process of forming the embryonic fibrous web 56, sufficient water may be removed, such as by a noncompressive process, from the embryonic fibrous web 56 before it becomes associated with the deflection member 64 so that the consistency of the embryonic fibrous web 56 may be from about 10% to about 30%.

While applicants decline to be bound by any particular theory of operation, it appears that the deflection of the fibers in the embryonic web and water removal from the embryonic web begin essentially simultaneously. Embodiments can, however, be envisioned wherein deflection and water removal are sequential operations. Under the influence of the applied differential fluid pressure, for example, the fibers may be deflected into the deflection conduit with an attendant rearrangement of the fibers. Water removal may occur with a continued rearrangement of fibers. Deflection of the fibers, and of the embryonic fibrous web, may cause an apparent increase in surface area of the embryonic fibrous web. Further, the rearrangement of fibers may appear to cause a rearrangement in the spaces or capillaries existing between and/or among fibers.

It is believed that the rearrangement of the fibers can take one of two modes dependent on a number of factors such as, for example, fiber length. The free ends of longer fibers can be merely bent in the space defined by the deflection conduit while the opposite ends are restrained in the region of the ridges. Shorter fibers, on the other hand, can actually be transported from the region of the ridges into the deflection conduit (The fibers in the deflection conduits will also be rearranged relative to one another). Naturally, it is possible for both modes of rearrangement to occur simultaneously.

As noted, water removal occurs both during and after deflection; this water removal may result in a decrease in fiber mobility in the embryonic fibrous web. This decrease in fiber mobility may tend to fix and/or freeze the fibers in place after they have been deflected and rearranged. Of course, the drying of the web in a later step in the process of this invention serves to more firmly fix and/or freeze the fibers in position.

Any convenient means conventionally known in the papermaking art can be used to dry the intermediate fibrous web 84. Examples of such suitable drying process include subjecting the intermediate fibrous web 84 to conventional and/or flow-through dryers and/or Yankee dryers.

In one example of a drying process, the intermediate fibrous web 84 in association with the deflection member 64 passes around the deflection member return roll 66 and travels in the direction indicated by directional arrow 70. The intermediate fibrous web 84 may first pass through an optional predryer 86. This predryer 86 can be a conventional flow-through dryer (hot air dryer) well known to those skilled in the art. Optionally, the predryer 86 can be a so-called capillary dewatering apparatus. In such an apparatus, the intermediate fibrous web 84 passes over a sector of a cylinder having preferential-capillary-size pores through its cylindrical-shaped porous cover. Optionally, the predryer 86 can be a combination capillary dewatering apparatus and flow-through dryer. The quantity of water removed in the predryer 86 may be controlled so that a predried fibrous web 88 exiting the predryer 86 has a consistency of from about 30% to about 98%. The predried fibrous web 88, which may still be associated with deflection member 64, may pass around another deflection member return roll 66 and as it travels to an impression nip roll 68. As the predried fibrous web 88 passes through the nip formed between impression nip roll 68 and a surface of a Yankee dryer 90, the ridge pattern formed by the top surface 72 of deflection member 64 is impressed into the predried fibrous web 88 to form a line element imprinted fibrous web 92. The imprinted fibrous web 92 can then be adhered to the surface of the Yankee dryer 90 where it can be dried to a consistency of at least about 95%.

The imprinted fibrous web 92 can then be foreshortened by creping the imprinted fibrous web 92 with a creping blade 94 to remove the imprinted fibrous web 92 from the surface of the Yankee dryer 90 resulting in the production of a creped fibrous structure 96 in accordance with the present invention. As used herein, foreshortening refers to the reduction in length of a dry (having a consistency of at least about 90% and/or at least about 95%) fibrous web which occurs when energy is applied to the dry fibrous web in such a way that the length of the fibrous web is reduced and the fibers in the fibrous web are rearranged with an accompanying disruption of fiber-fiber bonds. Foreshortening can be accomplished in any of several well-known ways. One common method of foreshortening is creping. The creped fibrous structure 96 may be subjected to post processing steps such as calendaring, tuft generating operations, and/or embossing and/or converting.

In addition to the Yankee fibrous structure making process/method, the fibrous structures of the present invention may be made using a Yankeeless fibrous structure making process/method. Such a process oftentimes utilizes transfer fabrics to permit rush transfer of the embryonic fibrous web prior to drying. The fibrous structures produced by such a Yankeeless fibrous structure making process oftentimes exhibit a substantially uniform density.

The molding member/deflection member of the present invention may be utilized to imprint line elements into a fibrous structure during a through-air-drying operation.

However, such molding members/deflection members may also be utilized as forming members upon which a fiber slurry is deposited.

In one example, the line elements of the present invention may be formed by a plurality of non-line elements, such as embossments and/or protrusions and/or depressions formed by a molding member, that are arranged in a line having an overall length of greater than about 4.5 mm and/or greater than about 6 mm and/or greater than about 10 mm and/or greater than about 20 mm and/or greater than about 30 mm and/or greater than about 45 mm and/or greater than about 60 mm and/or greater than about 75 mm and/or greater than about 90 mm.

The embryonic fibrous structure can be made from various fibers and/or filaments and can be constructed in various ways. For instance, the embryonic fibrous structure can contain pulp fibers and/or staple fibers. Further, the embryonic fibrous structure can be formed and dried in a wet-laid process using a conventional process, conventional wet-press, through-air drying process, fabric-creping process, belt-creping process or the like.

In one example, the embryonic fibrous structure is formed by a wet-laid forming section and transferred to a molding member, such as a patterned drying belt, with the aid of vacuum air. The embryonic fibrous structure takes on a mirrored-molding of the patterned belt to provide a fibrous structure according to the present invention. The transfer and molding of the embryonic fibrous structure may also be by vacuum air, compressed air, pressing, embossing, belt-nipped rush-drag or the like.

The fibrous structure of the present invention may comprise fibers and/or filaments. In one example, the fibrous structure comprises pulp fibers, for example, the fibrous structure may comprise greater than 50% and/or greater than 75% and/or greater than 90% and/or to about 100% by weight on a dry fiber basis of pulp fibers. In another example, the fibrous structure may comprise softwood pulp fibers, for example NSK pulp fibers.

The fibrous structure of the present invention may comprise strength agents, for example temporary wet strength agents, such as glyoxylated polyacrylamides, which are commercially available from Ashland Inc. under the tradename HERCOBOND, and/or permanent wet strength agents, an example of which is commercially available as KYMENE® from Ashland Inc., and/or dry strength agents, such as carboxymethylcellulose ("CMC") and/or starch.

The fibrous structures of the present invention may be a single-ply or multi-ply fibrous structure and/or a single-ply or multi-ply sanitary tissue product.

In one example of the present invention, a fibrous structure comprises cellulosic pulp fibers. However, other naturally-occurring and/or non-naturally occurring fibers and/or filaments may be present in the fibrous structures of the present invention.

In one example of the present invention, a fibrous structure comprises a throughdried fibrous structure. The fibrous structure may be creped or uncreped. In one example, the fibrous structure is a wet-laid fibrous structure.

In another example of the present invention, a fibrous structure may comprise one or more embossments.

The fibrous structure may be incorporated into a single- or multi-ply sanitary tissue product. The sanitary tissue product may be in roll form where it is convolutedly wrapped about itself with or without the employment of a core. In one example, the sanitary tissue product may be in individual sheet form, such as a stack of discrete sheets, such as in a stack of individual facial tissue.

NON-LIMITING EXAMPLES OF FIBROUS STRUCTURES OF THE PRESENT INVENTION

Example 1

A first stock chest of 100% eucalyptus fiber is prepared with a conventional pulper to have a consistency of about 3.0% by weight. The thick stock of the first hardwood chest is directed through a thick stock line where a wet-strength additive, HERCOBOND 1194 (commercially available from Ashland Inc.), is added in-line to the thick stock at about 0.5 lbs. per ton of dry fiber as it moves to the first fan pump.

A second stock chest of 100% eucalyptus fiber is prepared with a conventional pulper to have a consistency of about 3.0% by weight. The thick stock of the second chest is directed through a thick stock line where a wet-strength additive, HERCOBOND 1194, is added in-line to the thick stock at about 0.5 lbs. per ton of dry fiber as it moves to the second fan pump.

A third stock chest is prepared with 100% NSK fiber with a final consistency of about 3.0% by weight. The blended thick stock is directed to a disk refiner where it is refined to a Canadian Standard Freeness of about 580 to 625. The refined, NSK thick stock of the third stock chest is then directed through a thick stock line where a wet-strength additive, HERCOBOND 1194, is added to the thick stock at about 1.5 lbs. per ton of dry fiber. The refined, 100% NSK thick stock is then blended in-line with the eucalyptus thick stock from the second stock chest to yield a blended thick stock of about 55% eucalyptus and 45% NSK fiber as it is directed to the second fan pump.

A fourth stock chest of 100% trichome fiber is prepared with a conventional pulper to have a consistency of about 1.0% by weight. The thick stock of the fourth chest is directed through a thick stock line where it is blended in-line with the eucalyptus of the first stock chest to yield a blend of about 81% eucalyptus and 19% trichome fiber as it is directed to the first fan pump.

The blended eucalyptus and trichome fiber slurry diluted by the first fan pump is directed through the bottom headbox chamber (Yankee-side layer). The blend of eucalyptus fiber and NSK fiber slurry diluted by the second fan pump is directed through the center headbox chamber and to the top headbox chamber (Fabric-side) and is delivered in superposed relation to the fixed-roof former's forming wire to form thereon a three-layer embryonic web, of which about 34.5% of the top side is made up of blend of eucalyptus and NSK fibers, center is made up of about 34.5% of a blend of eucalyptus and NSK fibers and the bottom side (Yankee-side) is made up of about 31% of eucalyptus fibers and trichome fibers. Dewatering occurs through the outer wire and the inner wire and is assisted by wire vacuum boxes. Forming wire is an 84M design traveling at a speed of 800 fpm (feet per minute).

The embryonic wet web is transferred from the carrier (inner) wire, at a fiber consistency of about 24% at the point of transfer, to a patterned drying fabric. The speed of the patterned drying fabric is about 800 fpm (feet per minute). The drying fabric is designed to yield a pattern of substantially machine direction oriented linear channels having a continuous network of high density (knuckle) areas, such linear channels being the structure which imparts line elements to the web. This drying fabric is formed by casting an impervious resin surface onto a fiber mesh supporting fabric. The supporting fabric is a 127×52 filament, dual layer mesh. The thickness of the resin cast is about 12 mils above the supporting fabric.

While remaining in contact with the patterned drying fabric, the web is pre-dried by air blow-through pre-dryers to a fiber consistency of about 60% by weight.

After the pre-dryers, the semi-dry web is transferred to the Yankee dryer through a nip formed by the pressure roll surface and the Yankee surface where the Yankee surface has been pre-treated with a sprayed a creping adhesive coating. The coating is a blend consisting of Georgia Pacific's UNI- CREPE 457T20 and Vinylon Works' VINYLON 8844 at a ratio of about 92 to 8, respectively. The fiber consistency is increased to about 97% before the web is dry creped from the Yankee with a doctor blade.

The web is removed from the Yankee surface by a creping blade having a bevel angle of about 25 degrees and is positioned with respect to the Yankee dryer to provide an impact angle of about 81 degrees. The Yankee dryer is operated at a temperature of about 350° F. (177° C.) and a speed of about 800 fpm. The fibrous structure is wound in a roll using a surface driven reel drum having a surface speed of about 700 fpm (feet per minute). The fibrous structure may be subjected to post treatments such as embossing and/or tuft generating or application of a chemical surface softening. The fibrous structure may be subsequently converted into a two-ply sanitary tissue product having a basis weight of about 39 g/m$^2$. The plies of the two ply product are converted with Yankee-side surfaces out in order to form the consumer facing surfaces of the two-ply sanitary tissue product.

The sanitary tissue product is soft, flexible and absorbent. The sanitary tissue product exhibited the Free Fiber End Counts as shown in Table 2, Table 3 and FIGS. 12 and 13 as "Invention 1."

Example 2

A first stock chest of 100% eucalyptus fiber is prepared with a conventional pulper to have a consistency of about 3.0% by weight. The thick stock of the first hardwood chest is directed through a thick stock line where a wet-strength additive, HERCOBOND 1194 (commercially available from Ashland Inc.), is added in-line to the thick stock at about 0.5 lbs. per ton of dry fiber as it moves to the first fan pump.

Additionally, a second stock chest of 100% eucalyptus fiber is prepared with a conventional pulper to have a consistency of about 3.0% by weight. The thick stock of the second hardwood chest is directed through a thick stock line where a wet-strength additive, HERCOBOND 1194, is added in-line to the thick stock at about 0.5 lbs. per ton of dry fiber as it moves to the second fan pump.

A third stock chest is prepared with 100% NSK fiber with a final consistency of about 3.0%. The blended thick stock is directed to a disk refiner where it is refined to a Canadian Standard Freeness of about 580 to 625. The NSK thick stock of the third stock chest is then directed through a thick stock line where a wet-strength additive, HERCOBOND 1194, is added to the thick stock at about 1.5 lbs. per ton of dry fiber. The refined, 100% NSK thick stock is then directed to a third fan pump.

A fourth stock chest of 100% trichome fiber is prepared with a conventional pulper to have a consistency of about 1.0% by weight. The thick stock of the fourth chest is directed through a thick stock line where it is blended in-line with the eucalyptus fiber thick stock from the first stock chest to yield a blend of about 81% eucalyptus and 19% trichome fiber as it is directed to the first fan pump.

The blended eucalyptus and trichome fiber slurry diluted by the first fan pump is directed through the bottom headbox chamber (Yankee-side layer). The NSK fiber slurry diluted by the third fan pump is directed through the center headbox chamber. The eucalyptus fiber slurry diluted by the second fan pump directed to the top headbox chamber (Fabric-side) and delivered in superposed relation to the fixed-roof former's forming wire to form thereon a three-layer embryonic web, of which about 34.5% of the top side is made up of pure eucalyptus fibers, center is made up of about 34.5% of a NSK fiber and the bottom side (Yankee-side) is made up of about 31% of pure eucalyptus fiber. Dewatering occurs through the outer wire and the inner wire and is assisted by wire vacuum boxes. Forming wire is an 84M design traveling at a speed of 800 fpm (feet per minute).

The embryonic wet web is transferred from the carrier (inner) wire, at a fiber consistency of about 24% at the point of transfer, to a patterned drying fabric. The speed of the patterned drying fabric is about 800 fpm (feet per minute). The drying fabric is designed to yield a pattern of substantially machine direction oriented linear channels having a continuous network of high density (knuckle) areas. This drying fabric is formed by casting an impervious resin surface onto a fiber mesh supporting fabric. The supporting fabric is a 127×52 filament, dual layer mesh. The thickness of the resin cast is about 12 mils above the supporting fabric.

While remaining in contact with the patterned drying fabric, the web is pre-dried by air blow-through pre-dryers to a fiber consistency of about 60% by weight.

After the pre-dryers, the semi-dry web is transferred to the Yankee dryer through a nip formed by the pressure roll surface and the Yankee surface where the Yankee surface has been pre-treated with a sprayed a creping adhesive coating. The coating is a blend consisting of Georgia Pacific's UNICREPE 457T20 and Vinylon Works' VINYLON 8844 at a ratio of about 92 to 8, respectively. The fiber consistency is increased to about 97% before the web is dry creped from the Yankee with a doctor blade.

The web is removed from the Yankee surface by a creping blade having a bevel angle of about 25 degrees and is positioned with respect to the Yankee dryer to provide an impact angle of about 81 degrees. The Yankee dryer is operated at a temperature of about 350° F. (177° C.) and a speed of about 800 fpm. The fibrous structure is wound in a roll using a surface driven reel drum having a surface speed of about 700 fpm (feet per minute). The fibrous structure may be subjected to post treatments such as embossing and/or tuft generating or application of a chemical surface softening. The fibrous structure may be subsequently converted into a two-ply sanitary tissue product having a basis weight of about 48.8 g/m$^2$. The plies of the two ply product are converted with Yankee-side surfaces out in order to form the consumer facing surfaces of the two-ply sanitary tissue product.

The sanitary tissue product is soft, flexible and absorbent. The sanitary tissue product exhibited the Free Fiber End Counts as shown in Table 2, Table 3 and FIGS. 12 and 13 as "Invention 2."

Test Methods

Unless otherwise specified, all tests described herein including those described under the Definitions section and the following test methods are conducted on samples that have been conditioned in a conditioned room at a temperature of 23° C.±1.0° C. and a relative humidity of 50%±2% for a minimum of 12 hours prior to the test. All plastic and paper board packaging articles of manufacture, if any, must be carefully removed from the samples prior to testing. The samples tested are "usable units." "Usable units" as used herein means sheets, flats from roll stock, pre-converted flats, and/or single or multi-ply products. Except where noted all tests are conducted in such conditioned room, all tests are conducted under the same environmental conditions and in such conditioned room. Discard any damaged product. Do not test samples that have defects such as wrinkles, tears, holes, and like. All instruments are calibrated according to manufacturer's specifications. Samples conditioned as described herein are considered dry samples (such as "dry fibrous structures") for purposes of this invention.

Basis Weight Test Method

Basis weight of a fibrous structure is measured on stacks of twelve usable units using a top loading analytical balance with a resolution of ±0.001 g. The balance is protected from air drafts and other disturbances using a draft shield. A precision cutting die, measuring 3.500 in ±0.0035 in by 3.500 in ±0.0035 in is used to prepare all samples.

With a precision cutting die, cut the samples into squares. Combine the cut squares to form a stack twelve samples thick. Measure the mass of the sample stack and record the result to the nearest 0.001 g.

The Basis Weight is calculated in lbs/3000 $ft^2$ or $g/m^2$ as follows:

Basis Weight=(Mass of stack)/[(Area of 1 square in stack)×(No. of squares in stack)]

For example,

Basis Weight (lbs/3000 $ft^2$)=[[Mass of stack (g)/453.6 (g/lbs)]/[12.25 ($in^2$)/144 ($in^2/ft^2$)×12]]×3000 or,

Basis Weight ($g/m^2$)=Mass of stack (g)/[79.032 ($cm^2$)/10,000 ($cm^2/m^2$)×12]

Report result to the nearest 0.1 lbs/3000 $ft^2$ or 0.1 $g/m^2$. Sample dimensions can be changed or varied using a similar precision cutter as mentioned above, so as at least 100 square inches of sample area in stack.

Tensile Test Method: Elongation, Tensile Strength, TEA and Modulus

Elongation, Tensile Strength, TEA and Tangent Modulus are measured on a constant rate of extension tensile tester with computer interface (a suitable instrument is the EJA Vantage from the Thwing-Albert Instrument Co. Wet Berlin, N.J.) using a load cell for which the forces measured are within 10% to 90% of the limit of the cell. Both the movable (upper) and stationary (lower) pneumatic jaws are fitted with smooth stainless steel faced grips, 25.4 mm in height and wider than the width of the test specimen. An air pressure of about 60 psi is supplied to the jaws.

Eight usable units of a fibrous structure are divided into two stacks of four samples each. The samples in each stack are consistently oriented with respect to machine direction (MD) and cross direction (CD). One of the stacks is designated for testing in the MD and the other for CD. Using a one inch precision cutter (Thwing Albert JDC-1-10, or similar) cut 4 MD strips from one stack, and 4 CD strips from the other, with dimensions of 1.00 in ±0.01 in wide by 3.0-4.0 in long. Each strip of one usable unit thick will be treated as a unitary specimen for testing.

Program the tensile tester to perform an extension test, collecting force and extension data at an acquisition rate of 20 Hz as the crosshead raises at a rate of 2.00 in/min (5.08 cm/min) until the specimen breaks. The break sensitivity is set to 80%, i.e., the test is terminated when the measured force drops to 20% of the maximum peak force, after which the crosshead is returned to its original position.

Set the gauge length to 1.00 inch. Zero the crosshead and load cell. Insert at least 1.0 in of the unitary specimen into the upper grip, aligning it vertically within the upper and lower jaws and close the upper grips. Insert the unitary specimen into the lower grips and close. The unitary specimen should be under enough tension to eliminate any slack, but less than 5.0 g of force on the load cell. Start the tensile tester and data collection. Repeat testing in like fashion for all four CD and four MD unitary specimens. Program the software to calculate the following from the constructed force (g) verses extension (in) curve:

Tensile Strength is the maximum peak force (g) divided by the sample width (in) and reported as g/in to the nearest 1 g/in.

Adjusted Gauge Length is calculated as the extension measured at 3.0 g of force (in) added to the original gauge length (in).

Elongation is calculated as the extension at maximum peak force (in) divided by the Adjusted Gauge Length (in) multiplied by 100 and reported as % to the nearest 0.1%

Total Energy (TEA) is calculated as the area under the force curve integrated from zero extension to the extension at the maximum peak force (g*in), divided by the product of the adjusted Gauge Length (in) and specimen width (in) and is reported out to the nearest 1 $g*in/in^2$.

Replot the force (g) verses extension (in) curve as a force (g) verses strain curve. Strain is herein defined as the extension (in) divided by the Adjusted Gauge Length (in). Program the software to calculate the following from the constructed force (g) verses strain curve:

Tangent Modulus is calculated as the slope of the linear line drawn between the two data points on the force (g) versus strain curve, where one of the data points used is the first data point recorded after 28 g force, and the other data point used is the first data point recorded after 48 g force. This slope is then divided by the specimen width (2.54 cm) and reported to the nearest 1 g/cm.

The Tensile Strength (g/in), Elongation (%), Total Energy ($g*in/in^2$) and Tangent Modulus (g/cm) are calculated for the four CD unitary specimens and the four MD unitary specimens. Calculate an average for each parameter separately for the CD and MD specimens.

Calculations:

Geometric Mean Tensile=Square Root of [MD Tensile Strength (g/in)×CD Tensile Strength (g/in)]

Geometric Mean Peak Elongation=Square Root of [MD Elongation (%)×CD Elongation (%)]

Geometric Mean TEA=Square Root of [MD TEA ($g*in/in^2$)×CD TEA ($g/in^2$)]

Geometric Mean Modulus=Square Root of [MD Modulus (g/cm)×CD Modulus (g/cm)]

Total Dry Tensile Strength (TDT)=MD Tensile Strength (g/in)+CD Tensile Strength (g/in)

Total TEA=MD TEA ($g*in/in^2$)+CD TEA ($g*in/in^2$)

Total Modulus=MD Modulus (g/cm)+CD Modulus (g/cm)

Tensile Ratio=MD Tensile Strength (g/in)/CD Tensile Strength (g/in)

Free Fiber End Test Method

The Free Fiber End Count is measured using the Free Fiber End Test Method described below.

A fibrous structure sample to be tested is prepared as follows. If the fibrous structure is a multi-ply fibrous structure, separate the outermost plies being careful to not damage the plies. The outer surfaces of the outermost plies in a multi-ply fibrous structure will be the surfaces tested in this test.

If the fibrous structure is a single-ply fibrous structure, then both sides of the single-ply fibrous structure will be tested in this test.

All fibrous structure samples to be tested under this test should only be handled by the fibrous structure samples' edges.

A Kayeness or equivalent Coefficient of Friction (COF) Tester, from Dynisco L.L.C. of Franklin, Mass. is used in the test. A piece of 100% cotton fabric (square weave fabric; 58 warps/inch and 68 shutes/inch; warp filaments having a diameter of 0.012 in. and the shute filaments having a diameter of 0.010 in.) having a Coefficient of Friction of approximately 0.203 is cut and placed on a surface of the moveable base of the Coefficient of Friction Tester. The cotton fabric is taped to the surface of the moveable based so that it does not interfere with movement on the side support rails.

Cut a ¾ inch wide×1½ inch long strip from a fibrous structure to be tested. The strip should be cut from the fibrous structure at an angle of 45° to the MD and CD of the fibrous structure.

Tape the fibrous structure strip to a sled of the Coefficient of Friction Tester with SCOTCH® tape such that the surface of the fibrous structure to be tested is facing outward from the sled. Place the sled on the moveable base and start the COF Tester. Allow the tester to run until the sled has traveled 2½ inches along the cotton fabric. The pressure applied to the fibrous structure strip is 5 g/cm$^2$. This "brushing" sufficiently orients the free-fiber-ends in an upstanding disposition to facilitate counting them but care must be exerted to avoid breaking substantial numbers of interfiber bonds during the brushing inasmuch as that would precipitate spurious free-fiber-ends.

Remove the fibrous structure strip from the sled. Reattach the fibrous structure strip to the sled with ¾ inch SCOTCH® tape such that the drag will be in the opposite direction from the original motion and repeat the run for the same distance as before.

Remove the fibrous structure strip and prepare it for examination. The surface of the fibrous structure strip that has been in contact with the cotton fabric is the side to be examined.

Fold the fibrous structure strip in half across an edge of a glass slide cover slip (18 mm square, Number 1½ VWR International, West Chester, Pa., #48376-02 or equivalent) such that fold line runs across the narrower dimension of the fibrous structure strip and place glass slide cover slip and fibrous structure strip on a clean glass slide (1 inch×3 inch (2 per sample) VWR International, West Chester, Pa., #48300-047 or equivalent).

On another clean glass slide mark two lines ½ inch apart in the middle of the glass slide with a diamond etching pen. Fill in the etched line with a felt tip marker for greater clarity in reading the edges of the measurement area. Place this glass slide over the glass slide cover slip and fibrous structure strip such that the glass slide cover slip and fibrous structure strip is sandwiched between the two glass slides and the etched lines are against the folded fibrous structure strip and extend vertically from the folded edge of the fibrous structure strip. Secure the sandwich arrangement together with ¾ inch SCOTCH® brand tape.

Figure 31:
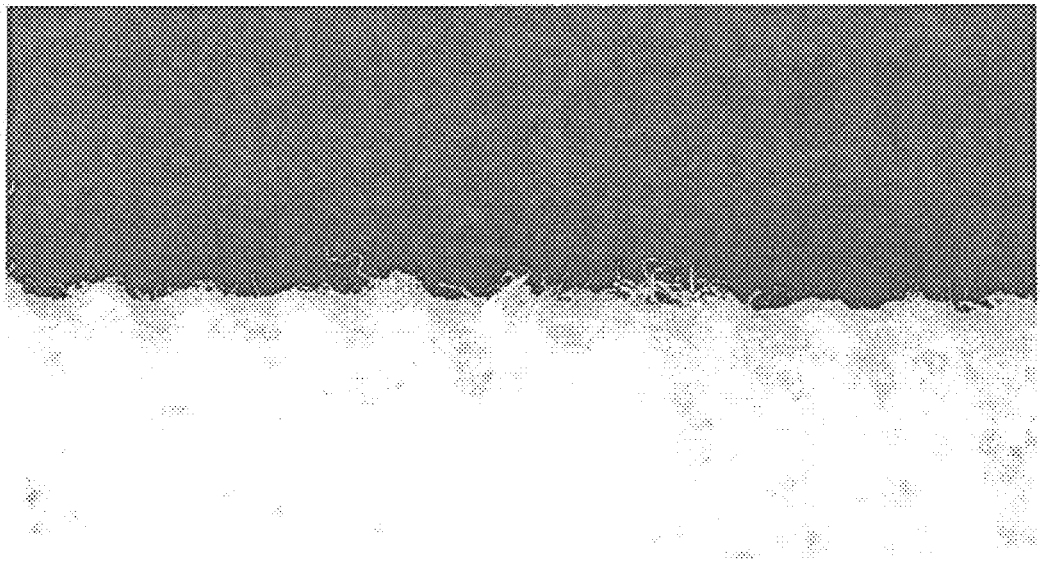
FIG. 31 is a micrograph of an example of a portion of a fibrous structure showing free fibers ends.

Using the Image Analysis Measure Tool (a Light/Stereo microscope, with digital camera—140× magnification, for example a Nikon DXM1200F and an image analysis program (Image Pro available from Media Cybernetics, Inc, Bethesda, Md.), place a calibrated stage micrometer onto the microscope stage and trace various scaled lengths of the micrometer between 0.1 mm and 1.0 mm for calibration. Verify calibration and record. Place the fibrous structure strip arrangement under the lens of the microscope, using the same magnification as for the micrometer, so that the edge that is folded over the glass cover slide slip is projected onto the screen/monitor. Lenses and distances should be adjusted so the total magnification is 140×. Project the image so that the magnification is 140×. All fibers that have a visible loose end extending at least 0.1 mm from the surface of the folded fibrous structure strip should be measured and counted. Individual fibers are traced to determine fiber length using the Image Pro software and are measured, counted and recorded. Starting at one etched line and going to the other etched line, the length of each free fiber end is measured. The focus is adjusted so each fiber to be counted is clearly identified. A free fiber end is defined as any fiber with one end attached to the fibrous structure matrix, and the other end projecting out of, and not returning back into, the fibrous structure matrix. Examples of free fiber ends in a fibrous structure are shown in FIG. 31. In other words, only fibers that have a visible loose (unbonded) or free end and having a free-end length of about 0.1 mm or greater are counted. Fibers that have no visible free end are not counted. Fibers having both ends free are also not counted. The length of each free fiber end is measured by tracing from the point at which it leaves the tissue matrix to its end. The length is measured using a mouse, light pen, or other suitable tracing device. The measurements are reported in millimeters and are stored in the image analysis text file. Data is transferred to a Microsoft Excel spreadsheet for sorting of the fiber lengths. The total number of free fiber ends (excluding free fiber ends less than 0.1 mm long) is calculated. The total number of free fiber ends within a certain length range ("Free Fiber End Count") can be calculated.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A creped fibrous structure comprising a plurality of fibers and a plurality of uninterrupted, wet-textured line elements, wherein at least one line element is substantially machine direction oriented and sinusoidal and has a Zone 1 having a first width and a Zone 2 having a second width, wherein the second width is less than the first width and the plurality of fibers comprises trichome fibers and the creped fibrous structure exhibits a Free Fiber End Count of greater than 130 to about 155 in the range of free fiber end lengths of from about 0.1 mm to about 0.25 mm as determined by the Free Fiber End Test Method.

2. The creped fibrous structure according to claim 1 wherein the plurality of fibers further comprises wood pulp fibers, wherein the wood pulp fibers are selected from the group consisting of hardwood pulp fibers, softwood pulp fibers and mixtures thereof.

3. The creped fibrous structure according to claim 2 wherein the hardwood pulp fibers comprise *eucalyptus* pulp fibers.

4. The creped fibrous structure according to claim 1 wherein greater than 50% by weight of the plurality of fibers comprises fibers selected from the group consisting of: trichome fibers, hardwood pulp fibers and mixtures thereof.

5. The creped fibrous structure according to claim 1 wherein the fibrous structure exhibits a basis weight of greater than 15 gsm to about 120 gsm as measured according to the Basis Weight Test Method.

6. The creped fibrous structure according to claim 1 wherein the fibrous structure is a layered fibrous structure.

7. The creped fibrous structure according to claim 1 wherein the fibrous structure is a homogeneous fibrous structure.

8. A single- or multi-ply sanitary tissue product comprising a creped fibrous structure according to claim 1.

9. A creped fibrous structure comprising a plurality of fibers and a plurality of uninterrupted, wet-textured line elements, wherein at least one line element is substantially machine direction oriented and sinusoidal and has a Zone 1 having a first width and a Zone 2 having a second width, wherein the second width is less than the first width and the plurality of fibers comprises trichome fibers and the creped fibrous structure exhibits a Free Fiber End Count of greater than 160 to about 205 in the range of free fiber end lengths of from about 0.25 mm to about 0.50 mm as determined by the Free Fiber End Test Method.

10. The creped fibrous structure according to claim 9 wherein the plurality of fibers further comprises wood pulp fibers wherein the wood pulp fibers are selected from the group consisting of hardwood pulp fibers, softwood pulp fibers and mixtures thereof.

11. The creped fibrous structure according to claim 10 wherein the hardwood pulp fibers comprise eucalyptus pulp fibers.

12. The creped fibrous structure according to claim 9 wherein greater than 50% by weight of the plurality of fibers comprises fibers selected from the group consisting of: trichome fibers, hardwood pulp fibers and mixtures thereof.

13. The creped fibrous structure according to claim 9 wherein the fibrous structure is a layered fibrous structure.

14. The creped fibrous structure according to claim 9 wherein the fibrous structure is a homogeneous fibrous structure.

15. A single- or multi-ply sanitary tissue product comprising a creped fibrous structure according to claim 9.

* * * * *